US007059499B2

(12) United States Patent
Masuda

(10) Patent No.: US 7,059,499 B2
(45) Date of Patent: Jun. 13, 2006

(54) FLUID-DISPENSING PUMP AND CONTAINER PROVIDED THEREWITH

(76) Inventor: Masatoshi Masuda, 2, 9-banchi, Takada-Cho, Saiin, Ukyo-ku, Kyoto-city, Kyoto 615-0031 (JP)

( * ) Notice: Subject to any disclaimer, the term of this patent is extended or adjusted under 35 U.S.C. 154(b) by 0 days.

(21) Appl. No.: 11/176,548

(22) Filed: Jul. 7, 2005

(65) Prior Publication Data

US 2006/0011661 A1 Jan. 19, 2006

(30) Foreign Application Priority Data

Jul. 15, 2004 (JP) ..... 2004-208299

(51) Int. Cl.
*B67D 5/56* (2006.01)

(52) U.S. Cl. ..... 222/321.9; 222/380; 137/512; 137/854

(58) Field of Classification Search ..... 222/321.9, 222/380; 137/512, 854
See application file for complete search history.

(56) References Cited

U.S. PATENT DOCUMENTS 2,571,893 A * 10/1951 Thomas ..... 137/854
4,155,489 A 5/1979 Steiman
5,042,694 A * 8/1991 Birmelin ..... 222/380
5,373,972 A * 12/1994 Bystrom et al. ..... 137/512
6,119,902 A 9/2000 Shimada et al.
6,681,962 B1 1/2004 Masuda

FOREIGN PATENT DOCUMENTS

JP 2002-066401 3/2002

* cited by examiner

*Primary Examiner*—Philippe Derakshani
(74) *Attorney, Agent, or Firm*—Knobbe, Martens, Olson & Bear LLP

(57) ABSTRACT

The fluid-dispensing pump 1 has an extendable/retractable member 10, an inflow valve mechanism 14 connected to the lower end of the extendable/retractable member 10, and an outflow valve mechanism 15 connected to the upper part of the extendable/retractable member 10. The outflow valve mechanism 15 includes a valve seat member 151 comprising a first valve seat portion 151*a* at the bottom of which an opening portion is formed and a second valve seat portion 151*b* which is located at the upper part of the first valve seat portion 151*a* and has a nearly cylindrical inner wall, a first valve member 152 configured to close the opening portion in the first valve seat portion 151*a*, and a second valve member 153 configured to contact the inner wall in the second valve seat portion 151*b*.

28 Claims, 17 Drawing Sheets

V1+V3=W
V1< W

FLUID-DISPENSING PUMP AND CONTAINER PROVIDED THEREWITH

BACKGROUND OF THE INVENTION

1. Field of the Invention

The present invention generally relates to a fluid-dispensing pump for dispensing a fluid stored inside a fluid-storing portion from a nozzle head set up above the fluid-storing portion by pressing the nozzle head.

2. Description of the Related Art

One such known fluid-dispensing pump, for example, is disclosed in Patent Reference 1. The fluid-dispensing pump described in Japanese Patent Application Laid-open No. 2002-66401 comprises a cylinder disposed at the upper part of a fluid-storing portion; a piston which can reciprocate inside the cylinder; a hollow coupling tube to connect the nozzle head and the piston so that a pressing force applied to the nozzle head can be transmitted to the piston to move the piston downward; a coil spring disposed on the periphery of the coupling tube for giving momentum to the piston in an ascending direction; an inflow valve mechanism for allowing a fluid stored in the fluid-storing portion to flow into the cylinder with an ascending motion of the piston; and an outflow valve mechanism for allowing the fluid flowed into the cylinder to flow out into the nozzle head through inside the coupling tube, with a descending motion of the piston.

According to this fluid-dispensing pump described in Japanese Patent Application Laid-open No. 2002-66401, the contact between the fluid and the coil spring for moving the piston upward can be avoided so that it becomes possible to effectively prevent corrosion of the coil spring or dissolution of metal components even when a coil spring providing strong momentum is used. It also becomes possible to easily remove the metal coil spring upon disposing the fluid-dispensing pump.

However, the fluid-dispensing pump described in Patent Reference 1 does not adopt a structure in which a fluid once flowed out into the nozzle head is restored into a cylinder. Therefore, the fluid once flowed out into the nozzle head remains in the nozzle head until it is pushed towards the dispensing port of the nozzle head by the fluid flowed out into the nozzle head from inside the cylinder next time. Consequently, as the period until the fluid in the cylinder flows out into the nozzle head next time becomes longer, the fluid once flowed into the nozzle head will be exposed to the air outside for a longer period of time, which causes the problem that the nature of the fluid may change. Further, the fluid remaining in the nozzle head may flow outside depending on the direction of the nozzle head.

SUMMARY OF THE INVENTION

The present invention has been achieved to solve at least the abovementioned problems and at least one object of the present invention is to provide a fluid-dispensing pump in which the amount of a fluid remaining inside the nozzle head can be minimized as much as possible.

The present invention can be practiced in various ways including, but not limited to, embodiments described below, wherein numerals used in the drawings are used solely for the purpose of ease in understanding of the embodiments which should not be limited to the numerals. Further, in the present specification, different terms or names may be assigned to the same element, and in that case, one of the different terms or names may functionally or structurally overlap or include the other or be used interchangeably with the other.

In an embodiment, the present invention provides a fluid-dispensing pump (e.g., 1, 5, 6, 7, 8) for dispensing a fluid stored inside a fluid-storing portion (e.g., 4, 4') from a nozzle head (e.g., 2) set up above the fluid-storing portion, by pressing the nozzle head, comprising: (a) an extendable/retractable member (e.g., 10, 10', 19) disposed between the 5fluid-storing portion and the nozzle head, for storing the fluid therein; (b) an inflow valve mechanism (e.g., 14, 14', 14", 50) disposed at a lower end of the extendable/retractable member, for introducing the fluid stored in the fluid-storing portion into the extendable/retractable member; and (c) an outflow valve mechanism (e.g., 15, 15', 15", 52) disposed at an upper end of the extendable/retractable member, for discharging therefrom the fluid contained in the extendable/retractable member to the nozzle head, said outflow valve mechanism comprising (i) a valve seat member (e.g., 151, 151', 151") having an opening portion (e.g., 151*d*, 151*d'*, 151*d"*) constituting a fluid path through which the fluid passes, (ii) a first valve member (e.g., 152, 154) for closing the fluid path by contacting a first portion (e.g., 151*a*, 151*a'*, 151*a"*) of the valve seat member in accordance with the pressure inside the extendable/retractable member, and (iii) a second valve member (e.g., 153) for closing the fluid path by contacting a second portion (e.g., 151*b*, 151*b'*, 151*b"*) of the valve seat member in accordance with the pressure inside the extendable/retractable member, wherein the first valve member and the second valve member are coupled with each other and unbiased, and the second portion is arranged downstream of the first portion.

The above embodiment further includes, but is not limited to, the following embodiments:

In the above embodiment, the first valve member and the second valve member are not biased, i.e., no constant physical force from structures is exerted on them via, for example, a spring or an elastic member toward the valve seat member. Further, the first valve member and the second valve member may be connected to no other structures, although they may be in contact with the valve seat member. In an embodiment, the first valve member may be more resilient than the second valve member. The first valve member may have a diameter or thickness which is slightly smaller than that of the second valve member, or the first valve member may be constituted by a material more flexible than that constituting the second valve member.

The valve seat member may have a cone-shaped bottom having the opening portion. The cone-shaped bottom has an annular projection (e.g., 155) around the opening portion, wherein the first valve member is in contact with the annular projection to close the fluid path at the opening portion. In an embodiment, the periphery of the first valve member may be in contact with an inner wall of the valve seat member. The periphery of the second valve member may be in contact with an inner wall of the valve seat member to close the fluid path.

The first valve member and the second valve member may be movably coupled with each other. The first valve member and the second valve member may be configured to (i) together move upward to an opening position and a separating position, respectively, when the pressure inside the extendable/retractable member exceeds the external pressure, and (ii) move downward from the opening position and the separating position to a closing position and a contacting position, respectively, when the pressure inside the extendable/retractable member falls below the external pressure, wherein the first valve member starts moving downward earlier than the second valve member. Further, the first valve member may be configured to move more easily than the second valve member. In an embodiment, the contacting position may have a width (e.g., W) through which the second valve member is configured to move while the second valve member is in contact with the second portion of the valve seat member until the first valve member moves to the closing position. In an embodiment, the width of the contacting position may be longer than a distance (e.g., V1) which the first valve member moves relative to the second valve member.

In an embodiment, the fluid-dispensing pump may further comprise a pressing portion (e.g., 22) having a discharge port (e.g., 21), wherein an upper portion of the valve seat member is connected to the pressing portion and is communicated with the discharge port, wherein when the first valve member and the second valve member are placed at the closing position and the connecting position, respectively, a periphery (e.g., 153*f*) of the second valve member is below a lower surface (e.g., 21*a*) of the discharge port, and when the first valve member and the second valve member are placed at the opening position and the separating position, respectively, the periphery of the second valve member and a periphery (e.g., 152*f*) of the first valve member are above the lower surface of the discharge port.

In an embodiment, a distance (e.g., V2) between the periphery of the first valve member and the periphery of the second valve member may be substantially or nearly the same as an inner diameter (e.g., D) of the discharge port, when the first valve member and the second valve member are placed at the closing position and the connecting position, respectively.

The first valve member may comprise (a) a first valve body (e.g., 152*a*, 154*a*) configured to move between a closing position for closing the fluid path and an opening position for opening the fluid path, and (b) a supporting portion (e.g., 152*b*, 154*b*) extending upward from the first valve body, configured to slidably support the second valve member, said second valve member comprising (c) a second valve body (e.g., 153*a*) configured to move between a contacting position for contacting an inner wall of the second portion (e.g., 151*b*) of the valve seat member and a separating position for separating from the inner wall, and (d) a connecting portion (e.g., 153*b*) to be connected to the supporting portion of the first valve member.

The supporting portion may have a seizing portion (e.g., 152*c*, 154*c*) at its top end for restricting the movement of the second valve member.

The first valve member and the second valve member may be configured to (i) together move upward to the opening position and the separating position, respectively, when the pressure inside the extendable/retractable member exceeds the external pressure, and (ii) move downward from the opening position and the separating position to the closing position and the contacting position, respectively, when the pressure inside the extendable/retractable member falls below the external pressure, wherein the first valve member starts moving downward earlier than the second valve member. The first valve member may be configured to move more easily than the second valve member.

In the above, the contacting position may have a width through which the second valve member is configured to move while the second valve member is in contact with the inner wall of the second portion of the valve seat member until the first valve member moves to the closing position. The width (e.g., W) of the contacting position may be longer than a distance (e.g., V1) in which the first valve member moves relative to the second valve member.

In an embodiment, the extendable/retractable member may comprise: (a) a cylinder (e.g., 11, 11', 11"); (b) a piston (e.g., 12, 12') which can reciprocate inside the cylinder; (c) a coupling tube (e.g., 13, 13', 13") in which a hollow fluid passage (e.g., 133, 133', 133") is formed by connecting the nozzle head and the piston so that pressing force applied to the nozzle head is transmitted to the piston to move downward; and (d) a urging member (e.g., 17), disposed around the coupling tube for urging the piston in an upward direction via the coupling tube. The extendable/retractable member may comprise a resinous bellows member (e.g., 170). The bellows member can also serve as the urging member.

In another aspect, the present invention provides a fluid-dispensing pump (e.g., 1, 5, 6, 7, 8) for discharging a fluid stored inside a fluid-storing portion (e.g., 4, 4') from a nozzle head (e.g., 2) set up above the fluid-storing portion, by pressing the nozzle head, comprising: (a) an extendable/retractable member (e.g., 10, 10', 19) which is disposed at an upper part of the fluid-storing portion and can change its shape between an extended position to store a relatively large amount of the fluid therein and a retracted position to store a relatively small amount of the fluid therein; (b) an inflow valve mechanism (e.g., 14, 14', 14", 50) which is connected to a lower end of the extendable/retractable member and allows the fluid stored in the fluid-storing portion to flow into the extendable/retractable member; and (c) an outflow valve mechanism (e.g., 15, 15', 15", 52) which is connected to the upper end of the extendable/retractable member and allows the fluid flowed into the extendable/retractable member to flow out into the nozzle head; said outflow valve mechanism being comprised of (c-1) a first valve seat portion (e.g., 151*a*, 151*a'*) at the bottom of which an opening portion (e.g., 151*d*, 151*d'*) is formed; (c-2) a first valve member (e.g., 152, 154) which has a first valve body (e.g., 152*a*, 154*a*) configure to move between a closing position for closing the opening portion and an opening position for opening the opening portion in the first valve seat portion and a supporting portion (e.g., 152*b*, 154*b*) set up from the first valve body; (c-3) a second valve seat portion (e.g., 151*b*, 151*b'*) which is disposed at the upper part of the first valve seat portion and has a nearly cylindrical inner wall; and (c-4) a second valve member (e.g., 153) which has a second valve body (e.g., 153*a*) configured to move between a contacting position for contacting the inner wall in the second valve seat portion and a separating position for separating from the inner wall and a connecting portion (e.g., 153*b*) to be connected to the supporting portion of the first valve member.

In the above, when the pressure inside the extendable/retractable member rises above the external pressure, the first valve body and the second valve body together move upward so that the first valve body moves to the opening position and at the same time the second valve body moves to the separating position; and when the pressure inside the extendable/retractable member falls below the external pressure, the first valve body and the second valve body together move downward, the second valve body moves to the contacting position, and then the first valve body moves to the closing position.

The above embodiment further includes, but is not limited to, the following embodiments:

In the above embodiment, the first and second valve members may or may not be biased toward the first and second valve seat member.

In an embodiment, a first seizing portion (e.g., 152*c*, 154*c*) may be formed at the top end of the supporting portion in the first valve member and at the same time a second seizing portion (e.g., 152*d*, 154*d*) is formed at its lower end. A first engaging portion (e.g., 153*c*) may be formed to engage with the first seizing portion and at the same time a second engaging portion (e.g., 153*d*) is formed to engage with the second seizing portion. The first valve member and the second valve member may be connected so that they can alternately slide between a first engaging position to engage the first seizing portion and the first engaging portion and a second engaging position to engage the second seizing portion and the second engaging portion.

In an embodiment, a moving distance (e.g., W) that the second valve body moves while contacting the inner wall in the second valve seat portion may be smaller than a sliding distance (e.g., V1) between the first valve member and the second valve member.

The extendable/retractable member may comprise: (a) a cylinder (e.g., 11, 11', 11"); (b) a piston (e.g., 12, 12') which can reciprocate inside the cylinder; (c) a coupling tube (e.g., 13, 13', 13") in which a hollow fluid passage (e.g., 133, 133', 133") is formed by connecting the nozzle head and the piston so that a pressing force applied to the nozzle head is transmitted to the piston to move it downward; and (d) a flexible member (e.g., 17) disposed on the periphery of the coupling tube for giving momentum to the piston in an ascending direction via the coupling tube. The extendable/retractable member may comprise a resinous bellows member (e.g., 170). The bellows member can also serve as the urging member.

In another aspect, the present invention provides a container comprising any of the foregoing fluid-dispensing pump, the fluid-storing portion (e.g., 4, 4'), the nozzle head (e.g., 2), and a lid portion (e.g., 3) which connects the dispensing pump to a mouth portion (e.g., 45, 45') of the fluid-storing portion.

In all of the aforesaid embodiments, any element used in an embodiment can interchangeably be used in another embodiment unless such a replacement is not feasible or causes adverse effect. Further, the present invention can equally be applied to apparatuses and methods.

For purposes of summarizing the invention and the advantages achieved over the related art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention. The drawings are oversimplified for illustrative purposes.

FIG. 6(*b*) is an enlarged view of relevant portions showing a first engaging position, and FIG. 6(*c*) is an enlarged view of relevant portions showing a second engaging position and a closing position.

FIGS. 7(*a*), 7(*b*), 7(*c*), and 7(*d*) are a top view, front view, cross-sectional view, and bottom view, respectively.

FIGS. 8(*a*), 8(*b*), and 8(*c*) are a top view, front view, and cross-sectional view, respectively.

FIGS. 9(*a*), 9(*b*), and 9(*c*) are a top view, front view, and cross-sectional view, respectively.

FIGS. 10(*a*), 10(*b*), and 10(*c*) are a top view, cross-sectional view, and bottom view, respectively.

FIGS. 13(*a*), 13(*b*), 13(*c*), and 13(*d*) are a top view, front view, cross-sectional view, and bottom view, respectively.

Figure 1:
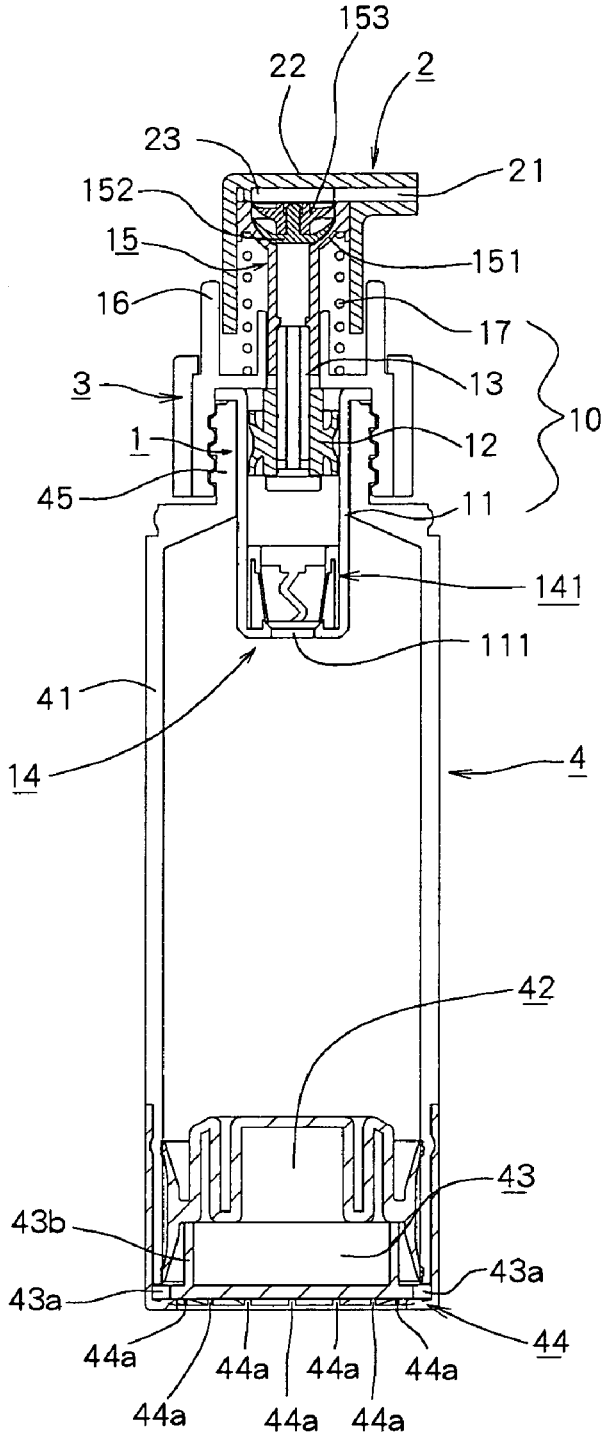
FIG. 1 is a longitudinal sectional view of a fluid container to which the fluid-dispensing pump 1 according to a first embodiment of the invention is applied.

Explanation of symbols used in the drawings are as follows: 1: Fluid-dispensing pump; 2: Nozzle head; 3: Lid member; 4: Fluid-storing portion; 5: Fluid-dispensing pump; 6: Fluid-dispensing pump; 7: Fluid-dispensing pump; 8: Fluid-dispensing pump; 10: Extendable/retractable member; 11: Cylinder; 12: Piston; 13: Coupling tube; 14: Inflow valve mechanism; 15: Outflow valve mechanism; 16: Screw member; 17: Coil spring; 18: Leak preventing mechanism; 19: Extendable/retractable member; 21: Discharge port; 22: Pressing portion; 23: Rib portion; 41: Cylinder member; 42: Piston member; 43: Inner lid; 44: Outer lid; 50: Inflow valve mechanism; 51: Leak preventing mechanism; 90: Suction tube; 111: Opening portion; 131: Fluid passage; 132: Inflow port; 133: Inserting portion; 134: Bonding portion; 141: Valve member; 151: Valve seat member; 152: First valve member; 153: Second valve member; 154: First valve member; 181: Leak preventing valve; 182: Wall surface; 501:

Inflow valve member; 502: Inflow valve seat member; 511: Leak preventing valve; 512: Wall surface.

DETAILED DESCRIPTION OF THE PREFERRED EMBODIMENT

The present invention will be explained with respect to preferred embodiments. However, the present invention is not limited to the preferred embodiments FIG. 1 is a longitudinal sectional view of a fluid container to which a fluid-dispensing pump according to a first embodiment of the present invention is applied.

This fluid container is used as a container for cosmetics for storing so-called gels such as hair gels and cleansing gels, creams such as nourishing creams and cold creams or liquid products such as lotion, used in the field of cosmetic treatment. Further, this fluid container can also be used as a container for medicines, solvents, foods and the like. In this specification, highly viscous liquids, semiliquids, or gels which solidify to sol or jelly, creams and regular liquids are all referred to as fluids.

This fluid container comprises the fluid-dispensing pump according to a first embodiment of the present invention, a nozzle head 2, a lid member 3, and a fluid-storing portion 4 in which a fluid is stored. The lid member 3 is engaged with a screw portion which is formed in the upper end of the fluid-storing portion 4 via a screw member 16.

Further in this specification, the up and down direction in FIG. 1 is specified as the up and down direction in the fluid container. Namely, in the fluid storing container according to the present invention, the nozzle head 2 side is defined as the upward direction and the piston member 42 side is defined as the downward direction, in FIG. 1.

The fluid-storing portion 4 has a cylindrical cylinder member 41, a piston member 42 which moves in the up and down direction inside this cylinder member 41, an inner lid 43 in which multiple air holes 43*a* are formed, and an outer lid 44 in which multiple air holes 44*a* are formed. The cylinder member 41 in this fluid-storing portion 4 and the fluid-dispensing pump 1 are liquid-tightly connected.

The outer lid 44 is fixed inserting the inner lid 43 at the lower part of the cylinder member 41. In the inner lid 43, a bottom raising portion 43*b* is formed for positioning the lowest position of the piston member 42 in the fluid storing container. The volume of the fluid which can be stored in the fluid storing container can be changed by changing the height of the bottom raising portion 43*b*.

The air holes 44*a* formed in the outer lid 44 and the air holes 43*a* formed in the inner lid 43 enable the air to pass through between the outside of the outer lid 44 and the inside of the inner lid 43 in the fluid storing container.

In this fluid storing container, a fluid stored in the fluid-storing portion 4 is discharged from a discharge port 21 in the nozzle head 2 by the action of the fluid-dispensing pump 1, which will be explained in detail thereinafter, by pressing a pressing portion 22 in the nozzle head 2 for reciprocal movement in the up and down direction. Then, the piston member 42 moves inside the cylinder member 41 towards the nozzle head 2 as the volume of the fluid inside the fluid-storing portion 4 decreases.

Next, the configuration of the fluid-dispensing pump 1 according to the first embodiment of the present invention will be explained. FIGS. 2 to 6 are longitudinal sectional views showing the fluid-dispensing pump 1 together with the nozzle head 2.

Figure 2:
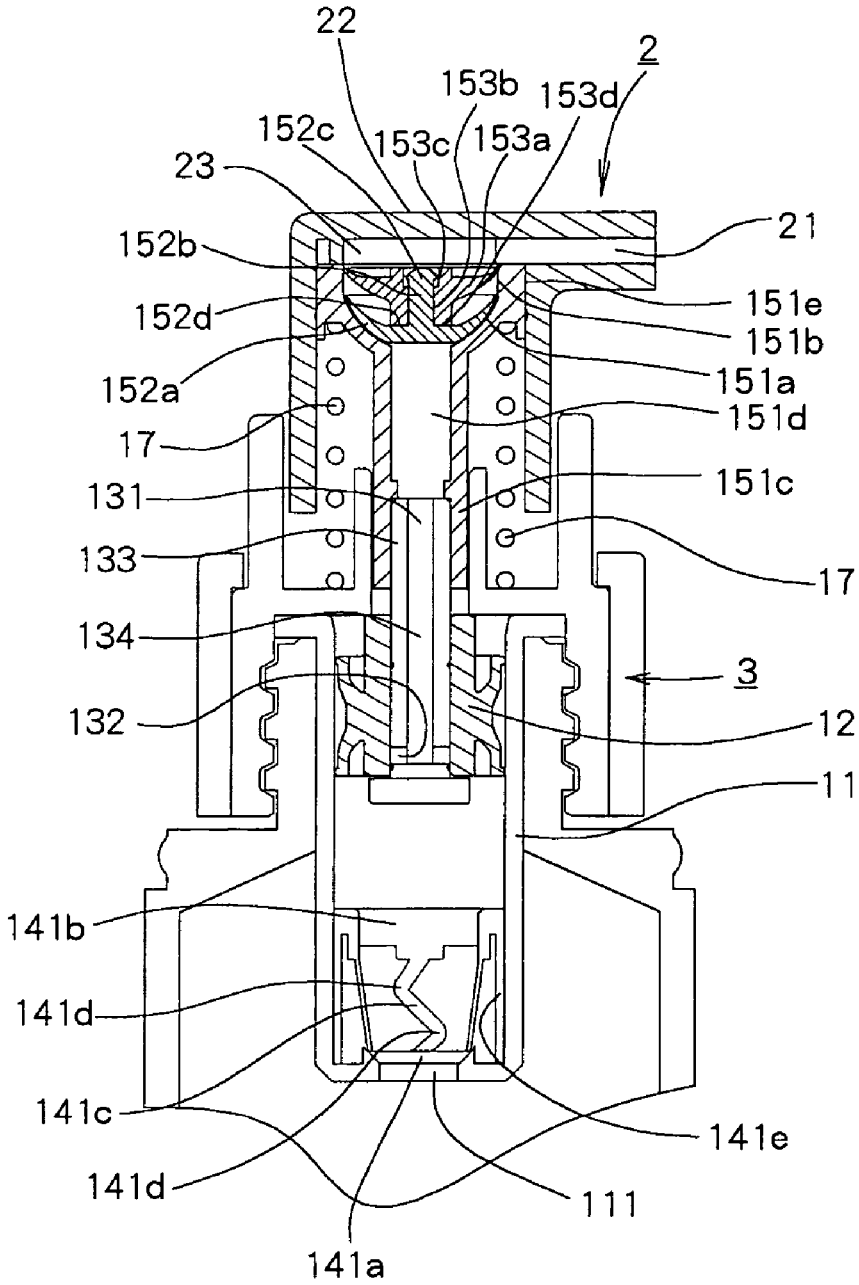
FIG. 2 is a longitudinal sectional view of the fluid-dispensing pump 1 together with the nozzle head 2.
Figure 3:
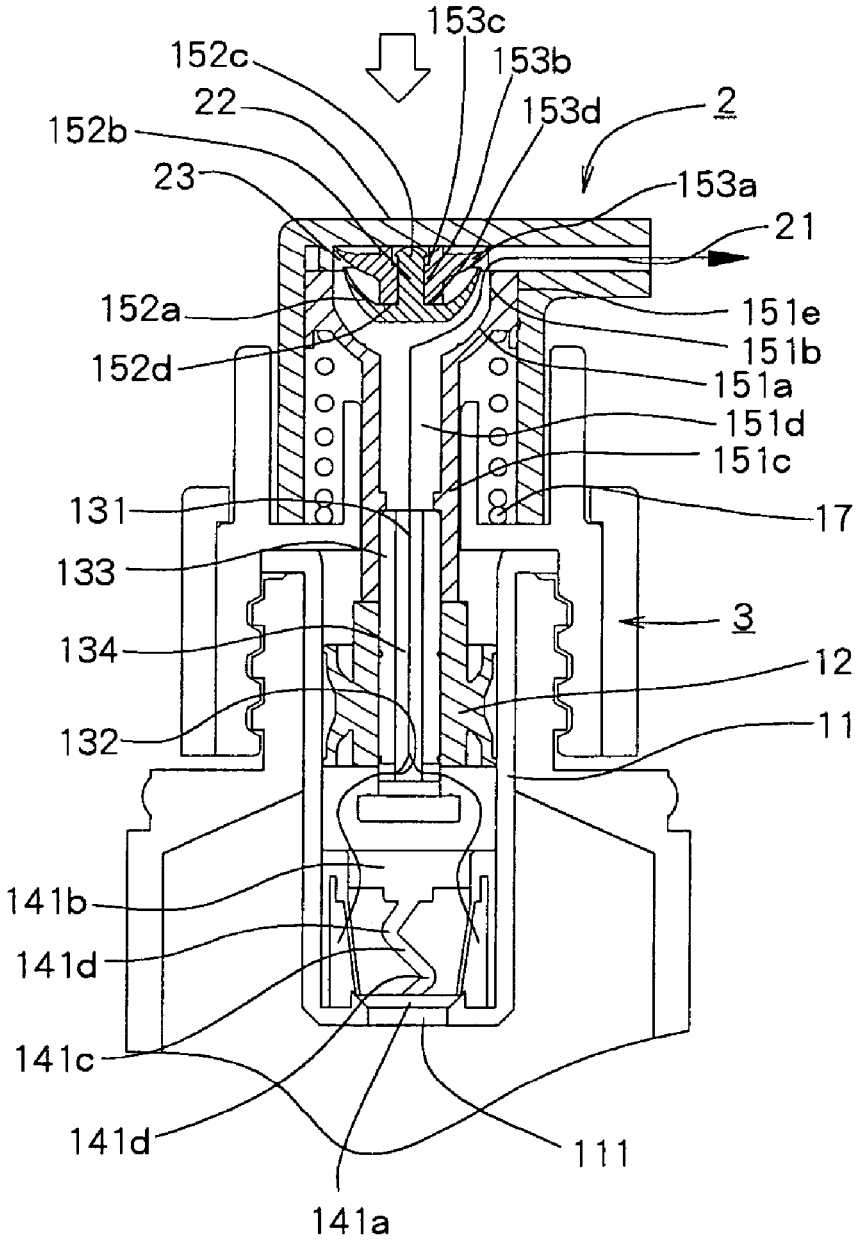
FIG. 3 is a longitudinal sectional view of the fluid-dispensing pump 1 together with the nozzle head 2.
Figure 4:
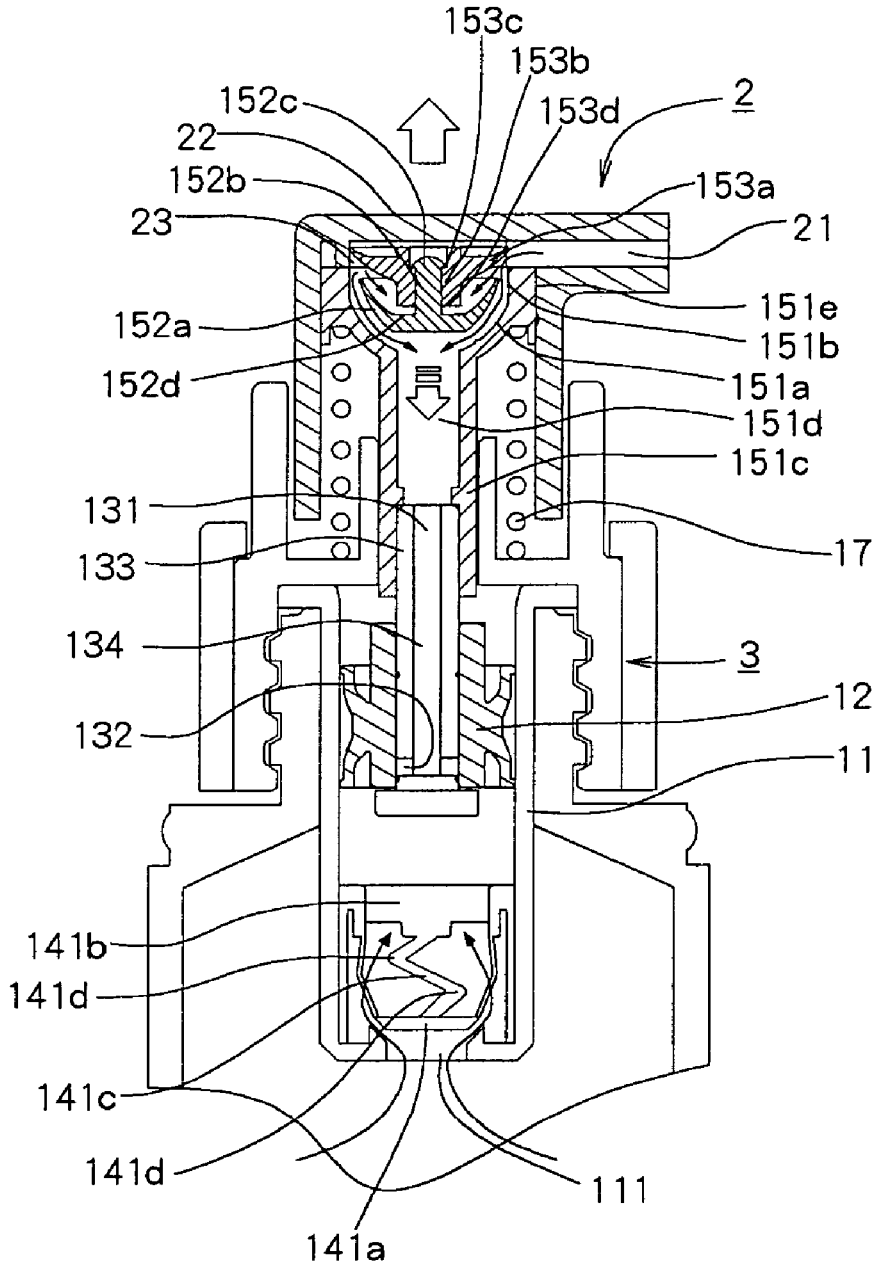
FIG. 4 is a longitudinal sectional view of the fluid-dispensing pump 1 together with the nozzle head 2.
Figure 5:
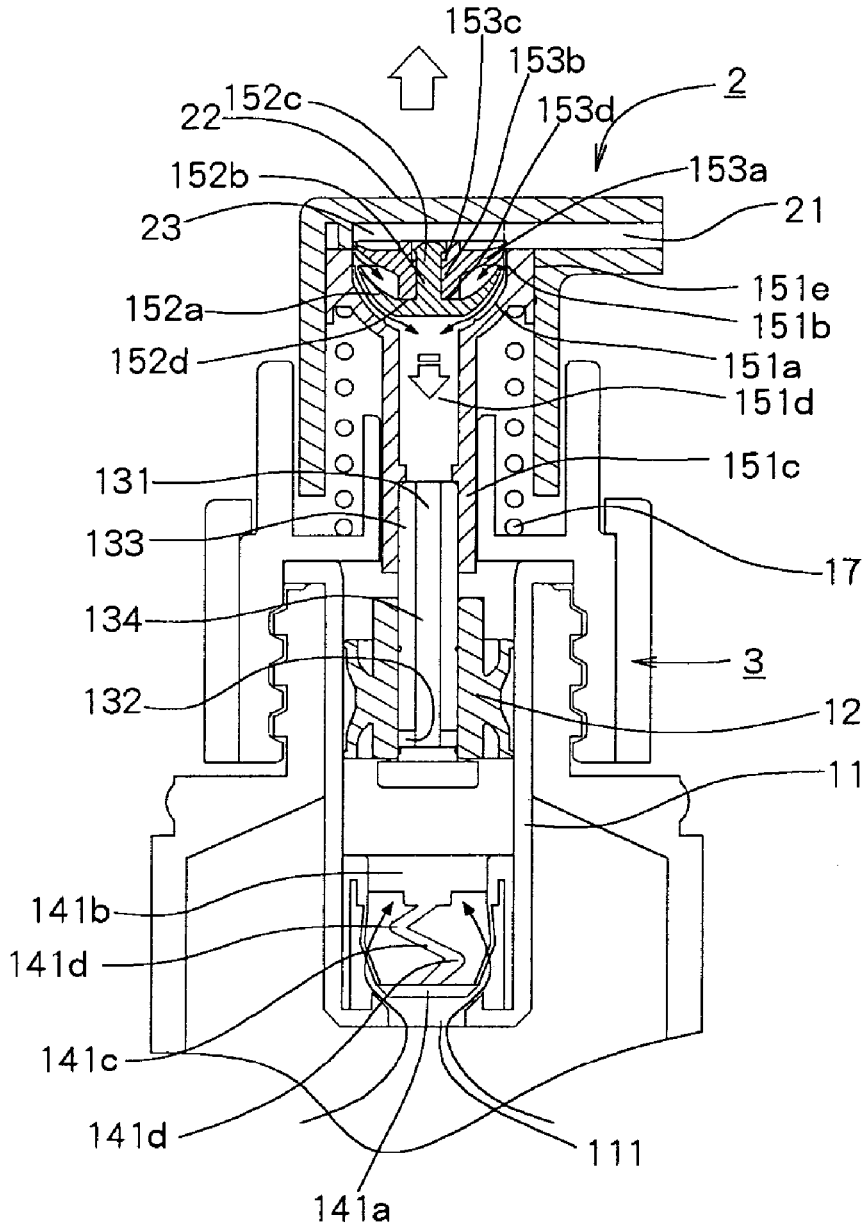
FIG. 5 is a longitudinal sectional view of the fluid-dispensing pump 1 together with the nozzle head 2.
Figure 6:
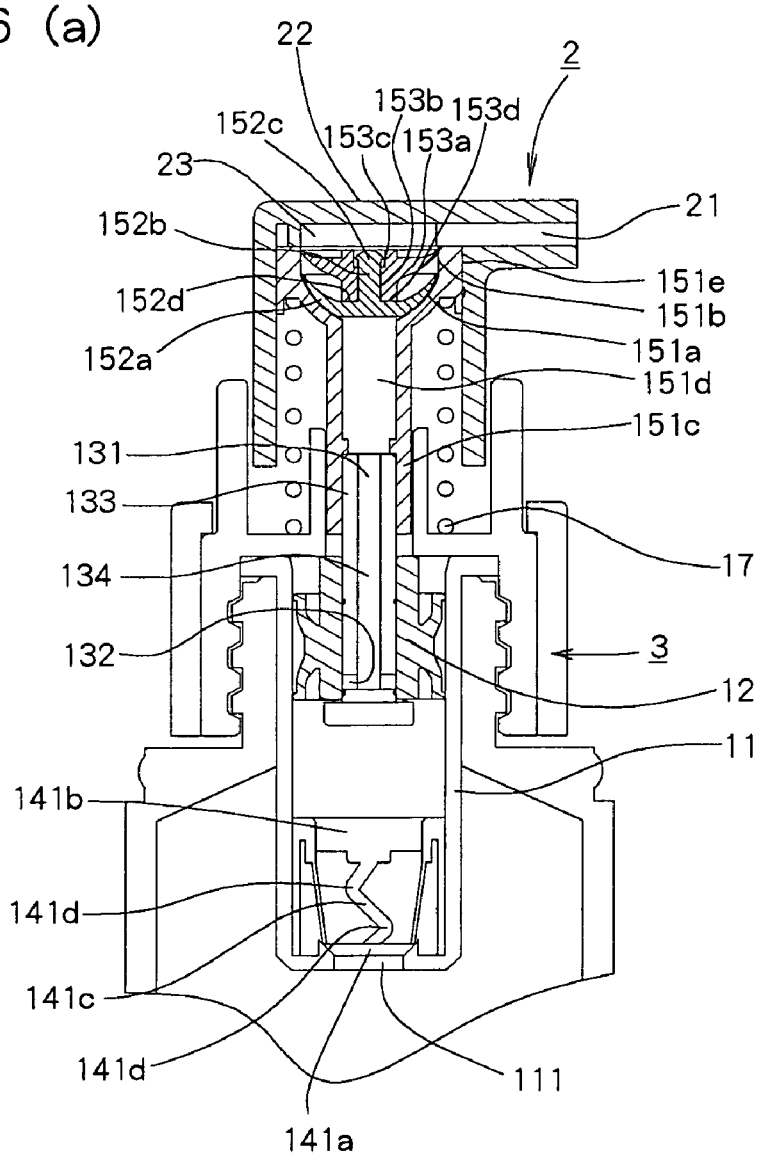
FIG. 6(*a*) is a longitudinal sectional view of the fluid-dispensing pump 1 together with the nozzle head 2.
Figure 6:
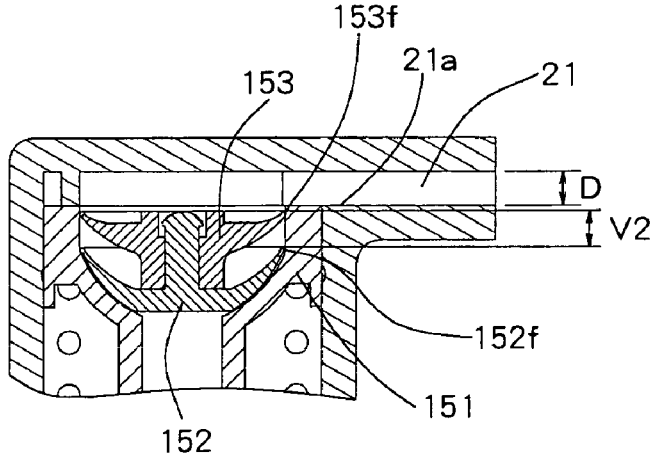
Figure 6:
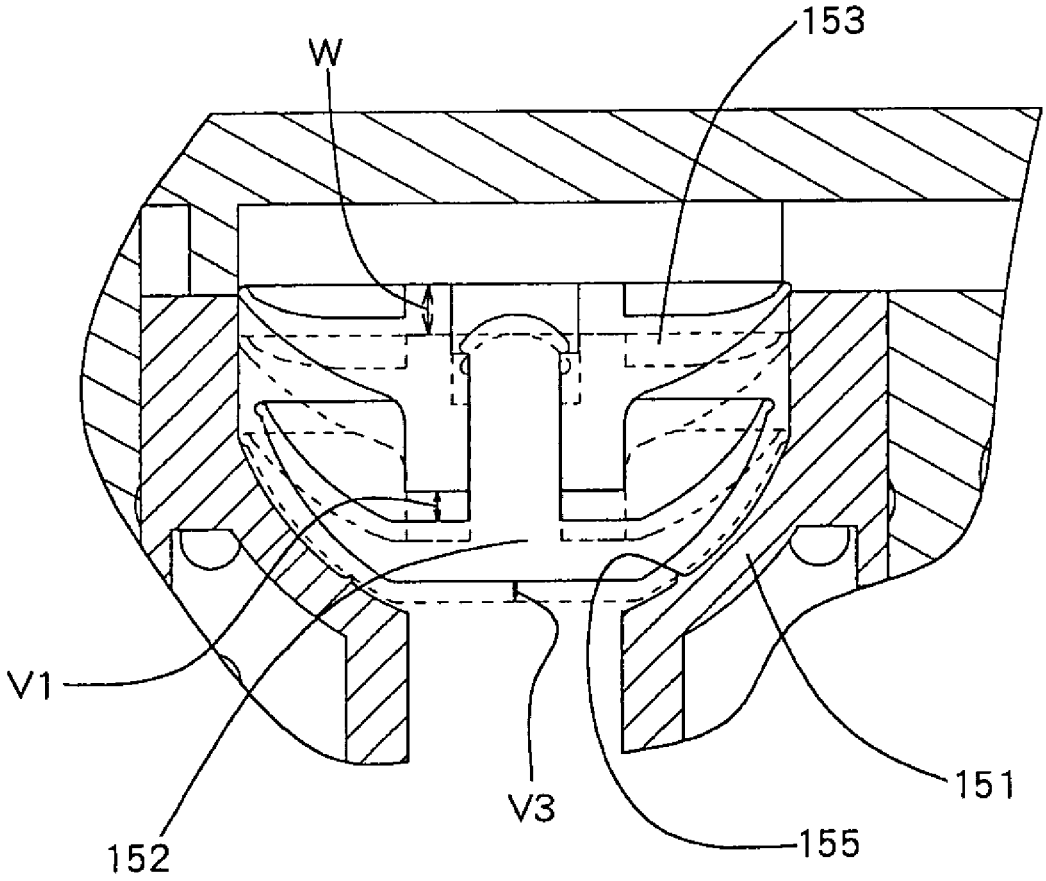
Figure 7A:
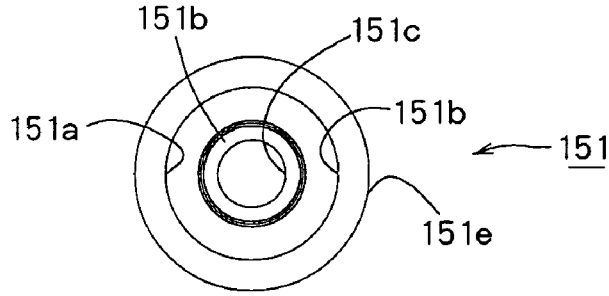
FIGS. 7(*a*)–7(*d*) are explanatory diagrams showing the valve seat member 151 with which the outflow valve mechanism 15 is constructed.
Figure 7B:
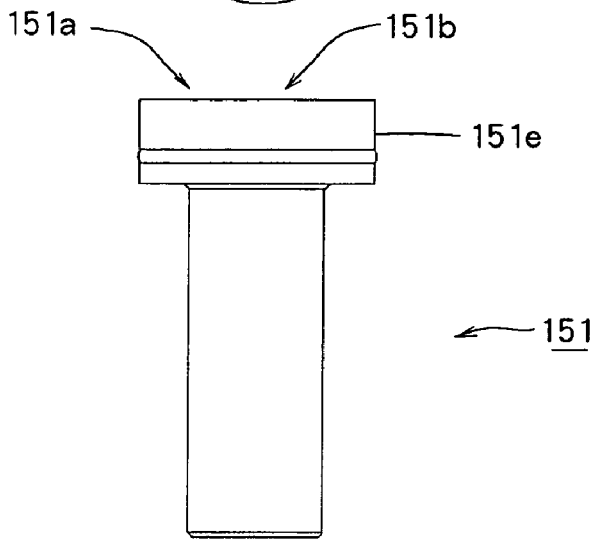
Figure 7C:
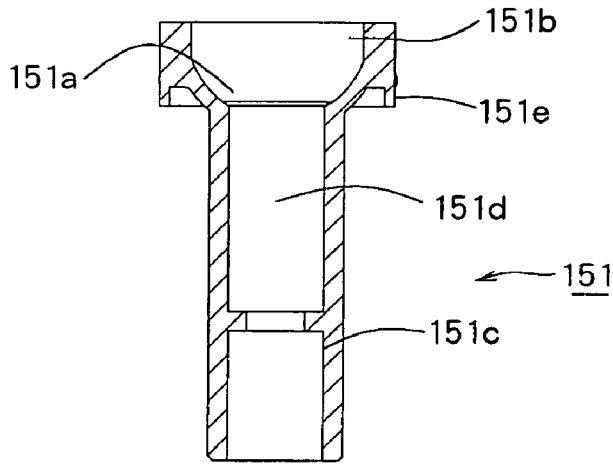
Figure 7D:
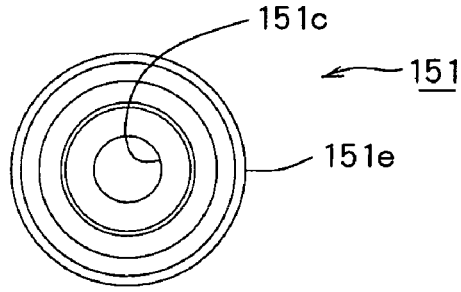

More specifically, FIG. 2 shows the stage when the fluid-dispensing pump 1 is allowed to stand to stand without receiving any stress. FIG. 3 shows the stage when the coupling tube 13 is moving downward together with the piston 12 by pressing the pressing portion 22 in the nozzle head 2. Further, FIG. 4 shows the stage when the coupling tube 13 is moving upward together with the piston 12, thereby drawing the fluid remaining in the discharge port 21 into the outflow valve mechanism 15 and the fluid-dispensing pump 1, by releasing the pressure onto the pressing portion 22 in the nozzle head 2. FIG. 5 shows the stage when the coupling tube 13 is moving upward together with the piston 12, thereby drawing the fluid remaining in the outflow valve mechanism 15 into the fluid-dispensing pump 1. FIG. 6(*a*) shows the stage when the inflow valve mechanism 14 and the outflow valve mechanism 15 are completely closed.

As shown in FIGS. 2 to 6(*c*), the fluid-dispensing pump comprises the extendable/retractable member 10, the inflow valve mechanism 14 which is connected to the lower end of the extendable/retractable member 10 and allows the fluid stored in the fluid-storing portion 4 to flow into the extendable/retractable member 10, and the outflow valve mechanism 15 which is connected to the upper end of the extendable/retractable member 10 and allows the fluid flowed into the extendable/retractable member 10 to flow out into the nozzle head 2.

Here, the extendable/retractable member 10 has a configuration which can change its shape between the extended position to store a relatively large amount of the fluid inside it and the retracted position to store a relatively small amount of the fluid inside it. This extendable/retractable member 10 comprises a cylinder 11 disposed in the upper part of the fluid-storing portion 4; a piston 12 which can reciprocate inside the cylinder 11; a coupling tube 13 in which a hollow fluid passage 131 is formed to move the piston 12 downward by transmitting a pressing force applied to the nozzle head 2 to the piston 12, by coupling the nozzle head 2 and the piston 12; and a coil spring 17 as a flexible member disposed on the periphery of the coupling tube 13 for giving momentum to the piston 12 in an ascending direction via the coupling tube 13.

Further, the piston 12 is, for example, constructed from a resin such as silicone rubber in such a way that its periphery is in close contact with the surface of the inner wall of the cylinder 11.

The coil spring 17 used is made of metal to obtain strong momentum. Yet, this coil spring 17 will not be in contact with the fluid passing through inside the coupling tube 13 because this coil spring 17 is disposed on the periphery of the coupling tube.

The inflow valve mechanism 14 is composed of a valve member 141 and an opening portion 111 formed in the cylinder 11.

The valve member 141 comprises a valve body 141*a* having a shape corresponding to the opening portion 111 formed in the lower end of the cylinder 11 for allowing the fluid stored in the fluid-storing portion 4 to flow into the cylinder 11, a supporting portion 141*b* fixed inside the cylinder 11 via a side support 141*e*, and four connecting portions 141*c* to connect the valve body 141*a* and the supporting portion 141*b*. Each of these four connecting portions 141*c* has a pair of flexuous portions 141*d*. In this way, this valve member 141 has a more appropriate flexibility.

The inflow valve mechanism 14 as mentioned above is formed in the lower end of the cylinder 11 and is to close or open the opening portion 111 through which the fluid-storing portion 4 and the cylinder 11 communicate. This inflow valve mechanism 14 is located at the contacting position in which the valve body 141*a* in the valve member 141 is in contact with the opening portion 111 when the pressure inside the extendable/retractable member 10 becomes equivalent or higher than the external pressure, thereby closing the opening portion 111. On the other hand, when the pressure inside the extendable/retractable member 10 becomes lower than the external pressure, the valve body 141*a* is located at the separating position separated from the opening portion 111 by the action of the connecting portion 141*c* in the valve member 141, thereby opening the opening portion 111.

The outflow valve mechanism 15 comprises a valve seat member 151 comprising a first valve seat portion 151*a* at the bottom of which the opening portion is formed and a second valve seat portion 151*b* which is located in the upper part of the first valve seat portion 151*a* and has a nearly cylindrical inner wall, a first valve member 152 configured to close the opening portion in the first valve seat portion 151*a*, and a second valve member 153 configured to contact the inner wall in the second valve seat portion 151*b*.

FIGS. 7(*a*)–7(*d*) are explanatory diagrams showing the valve seat member 151 which constitutes the outflow valve mechanism 15. More specifically, FIG. 7(*a*) is a plan view of the valve seat member 151, FIG. 7(*b*) is a side view of the valve seat member 151, FIG. 7(*c*) is a sectional side view of the valve seat member 151, and FIG. 7(*d*) is a back view of the valve seat member 151.

The valve seat member 151 comprises a first valve seat portion 151*a* at the bottom of which an opening portion is formed, a second valve seat portion 151*b* which is located in the upper part of the first valve seat portion 151*a* and has a nearly cylindrical inner wall, a engaging portion 151*c* which is located in the lower part of the first valve seat portion 151*a* to engage with the coupling tube 13, a passage 151*d* which is located between the first valve seat portion 151*a* and the engaging portion 151*c* to allow the fluid to pass through, and a bonding portion 151*e* to bond to the nozzle head 2.

Figure 8A:
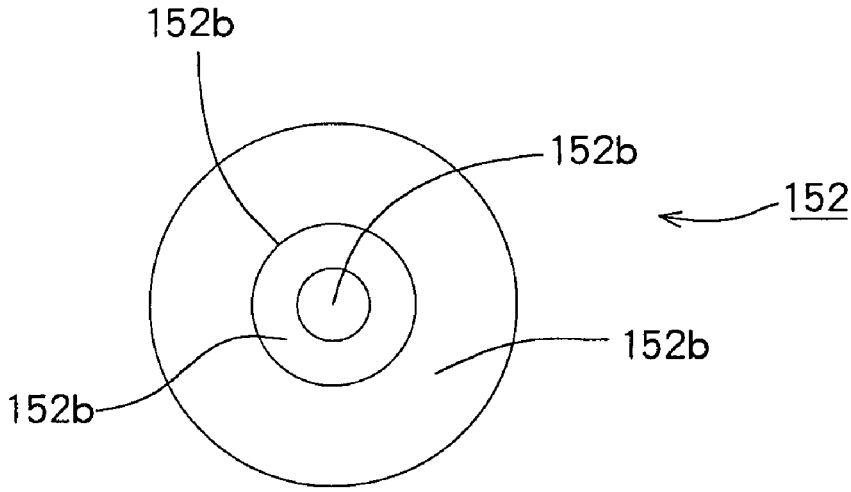
FIGS. 8(*a*)–8(*c*) are explanatory diagrams showing the first valve member 152 with which the outflow valve mechanism 15 is constructed.
Figure 8B:
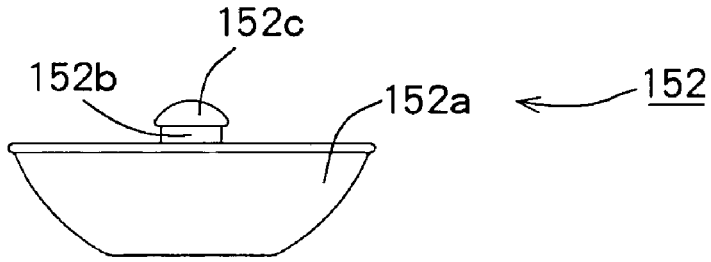
Figure 8C:
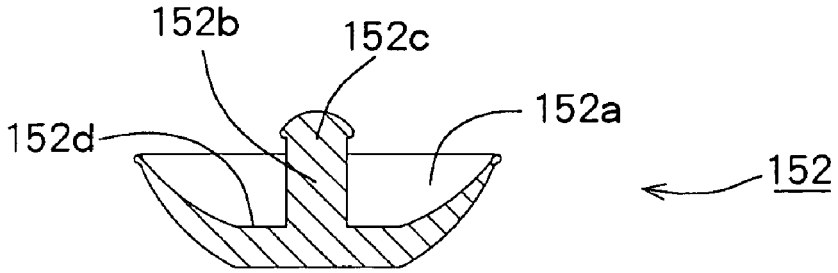

Further, FIGS. 8(*a*)–8(*c*) are explanatory diagrams showing the first valve member 152 which constitutes the outflow valve mechanism 15. More specifically, FIG. 8(*a*) is a plan view of the first valve member 152, FIG. 8(*b*) is a side view of the first valve member 152, and FIG. 8(*c*) is a sectional side view of the first valve member 152.

The first valve member 152 has a first valve body 152*a* which can move between the closing position to close the opening portion in the first valve seat portion 151*a* and the opening position to open said opening portion, and a supporting portion 152*b* set up from the first valve body 152*a*. Further, a first seizing portion 152*c* to restrict the upper limit of the movement of the second valve member 153, which will be explained in detail hereinafter, is formed on the top of the supporting portion 152*b* in this first valve member 152, and at the same time a second seizing portion 152*d* to restrict the lower limit of the movement of the second valve member 153 is formed at the lower end of the supporting portion 152*b*.

Figure 9A:
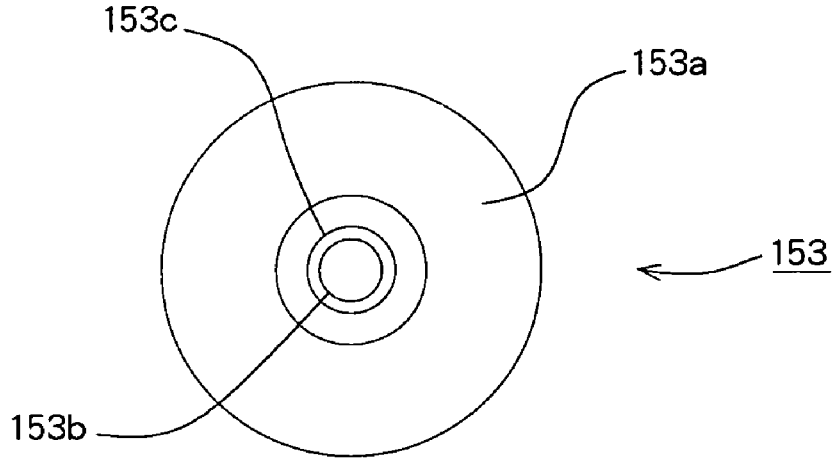
FIGS. 9(*a*)–9(*c*) are explanatory diagrams showing the second valve member 153 with which the outflow valve mechanism 15 is constructed.
Figure 9B:
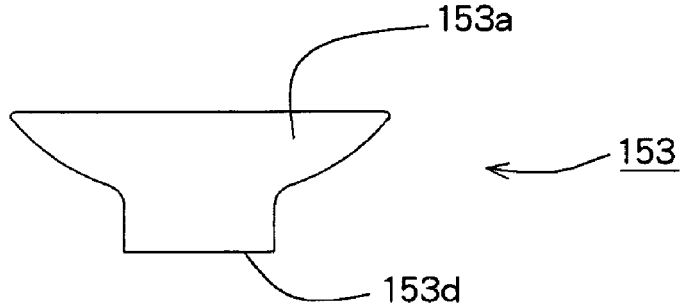
Figure 9C:
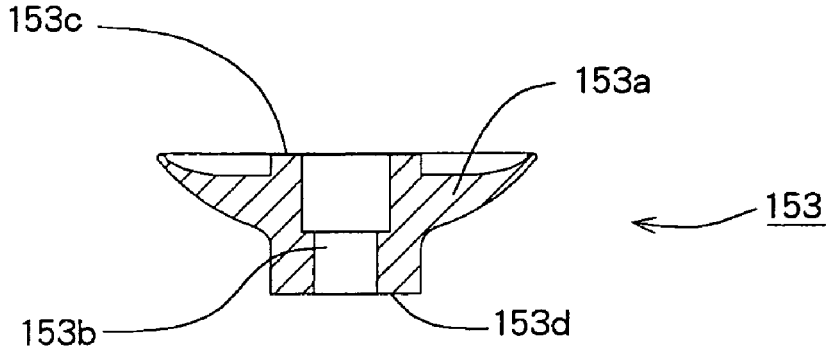

Further, FIGS. 9(*a*)–9(*c*) are explanatory diagrams showing the second valve member 153 which constitutes the outflow valve mechanism 15. More specifically, FIG. 9(*a*) is a plan view of the second valve member 153, FIG. 9(*b*) is a side view of the second valve member 153, and FIG. 9(*c*) is a sectional side view of the second valve member 153.

The second valve member 153 has a second valve body 153*a* which can move between the contacting position to contact with the inner wall in the second valve seat portion 151*b* and the separating position to separate from said inner wall, and a connecting portion 153*b* connected to the supporting portion 152*b* in the first valve body 152. Further, in the connecting portion 153*b* in the second valve member 153, a first engaging portion 153*c* to engage with the first seizing portion 152*c* in the first valve member 152 is formed and at the same time a second engaging portion 153*d* to engage with the second seizing portion 152*d* in the first valve member is formed.

These first valve member 152 and the second valve member 153 are so connected that they can alternately slide between the first engaging position to engage the first seizing portion 152*c* with the first engaging portion 153*c* and the second engaging position to engage the second seizing portion 152*d* with the second engaging portion 152*c*.

The outflow valve mechanism 15 which comprises this valve seat member 15, the first valve member 152 and the second valve member 153 is constructed in such a way that the first valve body 152*a* and the second valve body 153*a* together move upward when the pressure inside the extendable/retractable member 10 rises above the external pressure, so that the first valve body 152*a* moves to the opening position and at the same time the second valve body 153*a* moves to the separating position. On the other hand, the outflow valve mechanism 15 is so constructed that when the pressure inside the extendable/retractable member 10 falls below the external pressure, the first valve body 152*a* and the second valve body 153*a* together move downward, the second valve body 153*a* moves to the contacting position, and then the first valve body 152*a* moves to the closing position.

Figure 10A:
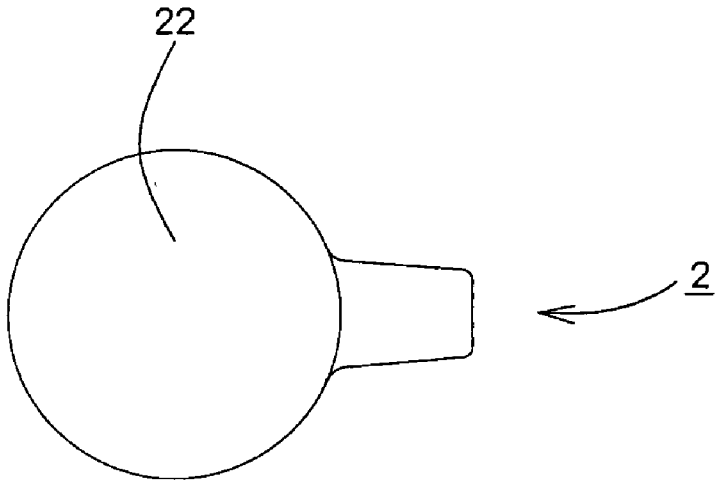
FIGS. 10(*a*)–10(*c*) are explanatory diagrams showing the nozzle head 2.
Figure 10B:
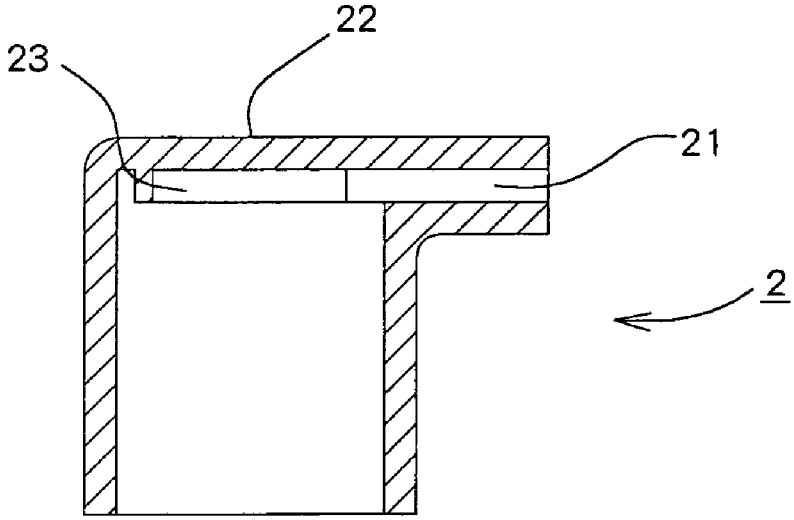
Figure 10C:
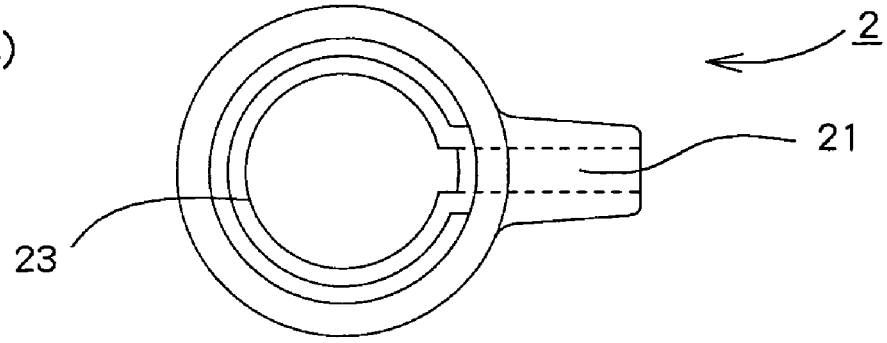

Further, FIGS. 10(*a*)–10(*c*) are explanatory diagrams showing the nozzle head 2. More specifically, FIG. 10(*a*) is a plan view of the nozzle 2, FIG. 10(*b*) is a sectional side view of the nozzle head 2, and FIG. 10(*c*) is a back view of the nozzle head 2.

The nozzle head 2 has a discharge port 21 to discharge the fluid, a pressing portion 22 to be pressed upon discharging the fluid, and a rib portion 23 to guide the movement of the second valve member 153 in the outflow valve mechanism 15, which will be explained in detail hereinafter. In this way, the second valve member 153 can be stably moved.

The coupling tube 13 has an inserting portion 133 to engage with the engaging portion 151*c* in the valve seat member 151 and a bonding portion 134 to slidably bond the piston 12. Further, a fluid pathway 131 is formed inside the coupling tube 13. Then, an inflow port 132 to communicate the fluid passage 131 to the inside of the cylinder 11 is formed inside the coupling tube 13 when the piston 12 slidably moves upward relative to the coupling tube 13.

The fluid discharging action of the fluid-dispensing pump 1 having such configuration will be explained again referring to FIGS. 2 to 6.

As illustrated in FIG. 2, when the fluid-dispensing pump 1 is allowed to stand without receiving any pressure, the valve body 141*a* in the valve member 141 is located at the contacting position to be in contact with the opening portion 111, the first valve body 152*a* is located at the closing position to close the opening portion in the first valve seat portion 151*a*, and the second valve body 153*a* is located at the connecting position to be in contact with the inner wall in the second valve seat portion 151*b*. Further, the first valve member 152 and the second valve member 153 are located at the second engaging position.

In the fluid-dispensing pump 1 as described above, as shown in FIG. 3, when the pressing portion 22 of the nozzle head 2 is pressed, the extendable/retractable member 10 changes its shape into the retracted position to store a relatively small amount of the fluid inside it. Thus, the pressure inside the extendable/retractable member 10 becomes higher than the external pressure. Here, the piston 12 slidably moves upward relative to the coupling tube 13 and the inflow port 132 communicates the fluid pathway 131 to the inside of the cylinder 11.

When the pressure inside the extendable/retractable member 10 thus becomes higher than the external pressure, the first valve body 152*a* moves upward by receiving the pressing force from the fluid inside the extendable/retractable member 10. As the first valve body 152*a* moves upward, the second engaging portion 153*d* receives the pressing force from the second seizing portion 152*d* in the upward direction, thereby moving the second valve body 153 upward. As the first valve body 152*a* and the second valve body 153*a* thus move upward, the first valve body 152*a* moves to the opening position and at the same time the second valve member 153*a* moves to the separating position, so that the fluid stored inside the extendable/retractable member 10 is discharged from the nozzle head 2.

As shown in FIG. 4, when the pressure onto the pressing portion 22 in the nozzle head 2 is released, the extendable/retractable member 10 changes its shape into the extended position to store a relatively large amount of the fluid inside it owing to the momentum of the coil spring 17. Consequently, the pressure inside the extendable/retractable member 10 becomes lower than the external pressure. Here, the piston 12 slidably moves downward relative to the coupling tube 13 and the inflow port 132 is closed by the piston 12.

Thus, when the pressure inside the extendable/retractable member 10 becomes lower than the external pressure, the first valve body 152*a* moves downward by receiving the sucking force from inside the extendable/retractable member 10. As the first valve body 152*a* moves downward, the first seizing portion 152*c* engages with the first engaging portion 153*c*. Namely, the first valve member 152 and the second valve member 153 are located at the first engaging position. Here, by the sucking force inside the extendable/retractable member 10, the fluid remaining in the vicinity of the discharging port 21 in the nozzle head 2 passes through the second valve body 153*a* and is sucked into the extendable/retractable member 10. Consequently, the fluid once flowed out into the discharge port 21 of the nozzle head 2 can be prevented from remaining in the vicinity of the discharge port 21. In this way, it is possible to prevent a change in the nature of the fluid, which is caused by exposing the fluid once flowed out into the nozzle head to the air outside.

Further, in the inflow valve mechanism 14, the valve body 141*a* is located at the separating position separated from the opening portion 111 by the action of the connecting portion 141*c* in the valve member 141, thereby opening the opening portion 111. Here, the fluid stored in the fluid-storing portion 4 passes through the inflow valve mechanism 14 and flows into the extendable/retractable member 10 by the sucking force inside the extendable/retractable member 10.

In the stage as described above, as shown in FIG. 5, the second valve body 153*a* is located at the contacting position. Here, by the sucking force inside the extendable/retractable member 10, the fluid sucked into between the first valve body 152*a* and the second valve body 153*a* further passes through the first valve body 152*a* and is sucked into the extendable/retractable member 10. Then, as the volume of the fluid sucked into between the first valve body 152*a* and the second valve body 153*a* decreases, the first valve member 152 and the second valve member 153 are located at the second engaging position.

Further, when the pressure inside the extendable/retractable member 10 becomes equal to the external pressure, the first valve body 152*a* is located in the closing position as shown in FIG. 6(*a*). Further, in the inflow valve mechanism 14, the valve body 141*a* is located in the contacting position to be in contact with the opening portion 111 to close the opening portion 111 by the action of the connecting portion 141*c* in the valve member 141.

FIG. 6(*b*) shows the first engaging position. FIG. 6(*c*) shows the second engaging position and the closing position. In FIG. 6(*b*), the broken lines show the position indicated in FIG. 6(*c*). As shown in FIG. 6(*b*), in the fluid-dispensing pump 1 according to this first embodiment, a moving distance (W) which the second valve body 153*a* moves while keeping contact with the inner wall in the second valve seat portion 151*b* is set to be longer than a distance between the first engaging position and the second engaging position (a slidably moving distance (V1) between the first valve member 152 and the second valve member 153). In this figure, the equation W=V1+V3 is satisfied, wherein V3 is a distance which the first valve member 152 moves after the second valve member 153 become in contact with the inner wall of the valve seat member 151 until the first valve member 152 is placed at the closing position.

In this way, it is possible to ensure that the second valve body 153*a* moves to the contacting position and then the first valve body 152*a* moves to the closing position.

In the above, at the first engaging position, the first valve member 152 is not placed at the closing position. After the first engaging position (also at the contacting position), the following phenomena may occur: 1a) The fluid between the second valve member 153 and the first valve member 152 and the fluid under the first valve member 152 are drawn toward the extendable/retractable member 10 by sucking force, while the second valve member 153 maintains unmoved, thereby attracting the first valve member 152 to the second valve member 153 (i.e., the second engaging position without reaching the closing position); and 1b) thereafter, the fluid under the first valve member 152 is kept drawn toward the extendable/retractable member 10, thereby moving both the first and second valve members 152, 153 to the closing position while maintaining the second engaging position.

Alternatively, 2a) the fluid between the second valve member 153 and the first valve member 152 and the fluid under the first valve member 152 are drawn toward the extendable/retractable member 10 by sucking force, while both the first and second valve members 152, 153 move downward; and 2b) as the fluid between the second valve member 153 and the first valve member 152 is drawn, the second valve member 153 gets closer to the first valve member 152, thereby positioning the first and second valve members 152, 153 at the closing position as well as the second engaging position. Any movements between the above two scenarios can occur. In an embodiment, the first valve member may be at the closing position without going through the first engaging position. In an embodiment, when the first valve member is at the closing position, the first and second valve members are not at the second engaging position, i.e., the bottom of the second valve member is not in contact with the first valve member. In this case, if V1' is defined as an actual moving distance whereas V1 is defined as a potential moving distance, the inequality V1'<W<V1 can be satisfied.

In order to promote withdrawal of the fluid between the first valve member and the second valve member, the first valve member may have a diameter which is smaller than that of the second valve member. In this case, the periphery of the first valve member may not be in liquid-tight contact with the inner wall of the valve seat member. Instead, the surface of the valve seat member may have one or more annular projection 155 around the opening portion (FIG. 6(*b*)), so that the first valve member can be in liquid-tight contact with the annular projection.

In an embodiment, the first valve member and the second valve member have the same diameter, but may have different resilience. The first valve member may be more resilient than the second, and the first valve member may have a thickness which is smaller than that of the second valve member.

These valve seat member and valve member may be constituted by, for example, a resilient material such as a resin including polyethylene and polypropylene, rubber composite such as silicon rubber, or a mixture of the foregoing. The second valve member may be made of a material which is less flexible than a material of which the first valve member is mad, so that the scenario 1a, 1b tends to occur, rather than the scenario 2a, 2b. The second valve member also can be shaped so that it becomes less flexible than the first valve member. For example, the second valve body may be thicker than the first valve body.

Additionally, the first and second valve bodies may have an outer diameter which is slightly larger (e.g., about 5–10%) than the inner diameter of the valve seat member, so that a seal between the first and second valve members and the valve seat member can be secured.

In another embodiment, the first and second valve members are integrally formed, i.e., they do not move relative to each other (V1=0). In that case, the distance W is set to be longer than the distance V3.

Further, as shown in FIG. 6(*c*), in this embodiment, when the first valve member 152 and the second valve member 153 are placed at the closing position and the connecting position, respectively, a periphery 152*f* of the first valve member and the periphery 153*f* of the second valve member are below a lower surface 21*a* of the discharge port 21. When the first valve member 152 and the second valve member 153 are placed at the opening position and the separating position, respectively, the periphery 152*f* of the first valve member and the periphery 153*f* of the second valve member are above the lower surface 21*a* of the discharge port 21.

The number of valve members need not be two. Three or more valve members can be used. As long as more than one valve member is used, even though the valve members are not biased or urged by an urging member (or not connected to other structures), the valve members can stay in place in the valve seat member due to friction at the peripheries of the valve bodies. In an embodiment, the peripheral edge of the valve member may be thickened and rounded.

The shape of the valve member and the valve seat member need not be circular and can be oval or polygonal.

Next, other embodiments of the present invention will be explained referring to drawings. The members which are the same as those used in the first embodiment described above are numbered with the same numbers and used without detailed explanation.

Figure 11:
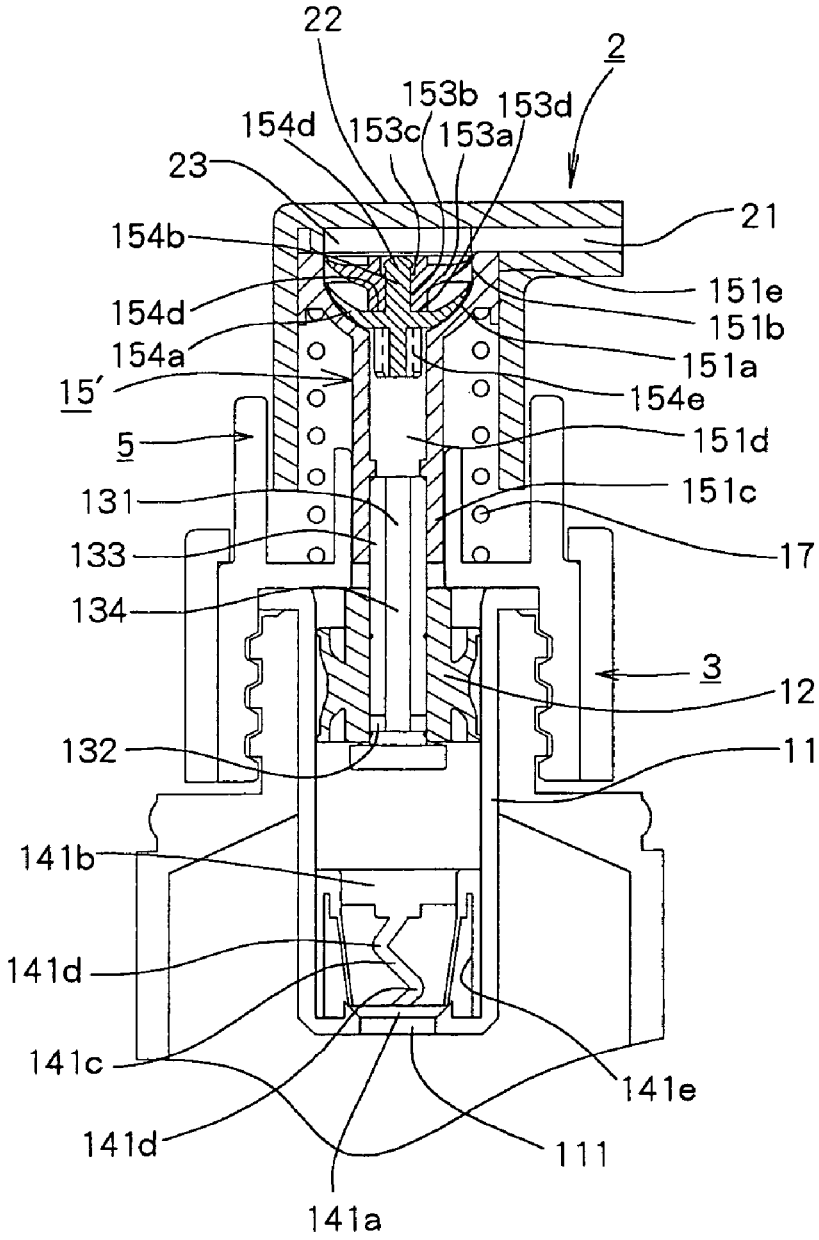
FIG. 11 is a longitudinal sectional view showing a fluid-dispensing pump 5 together with the nozzle head 2 according to a second embodiment of the present invention.
Figure 12:
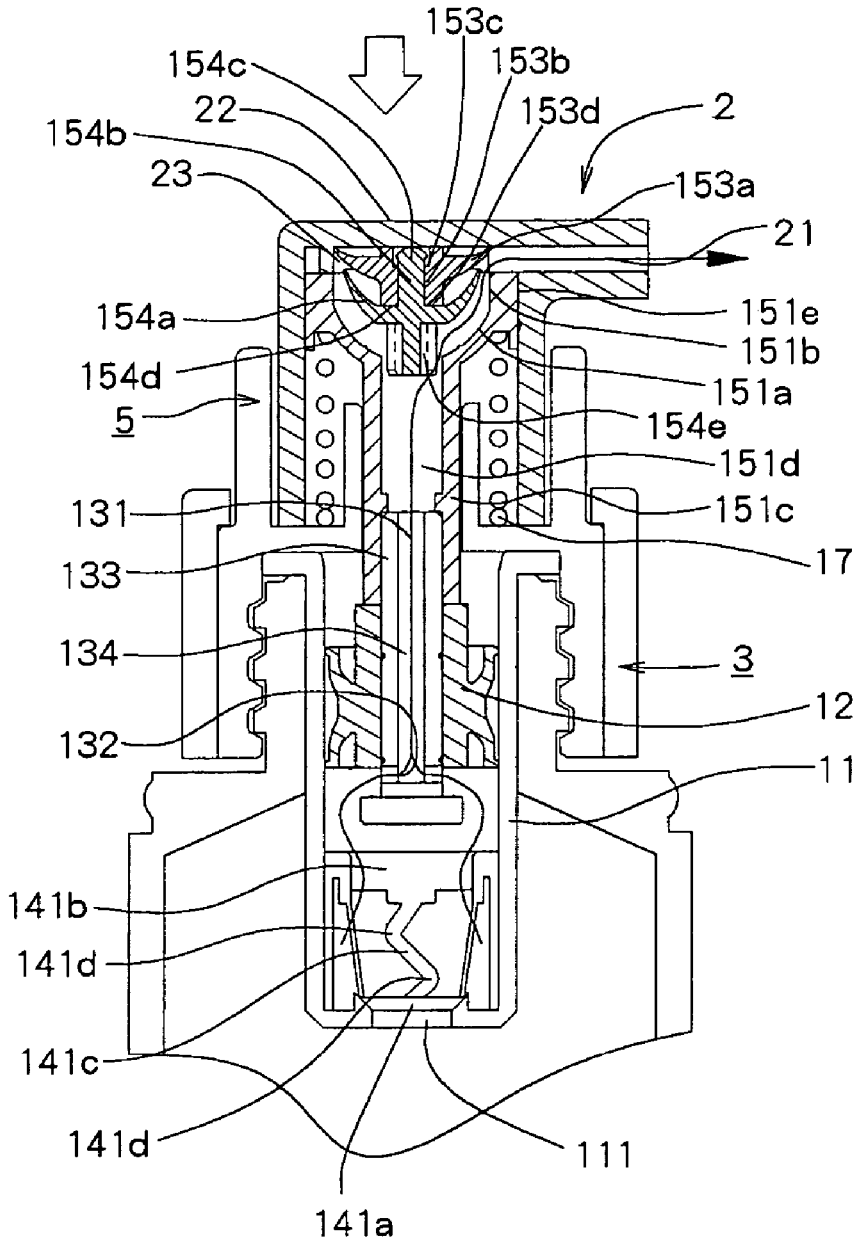
FIG. 12 is a longitudinal sectional view showing the fluid-dispensing pump 5 together with the nozzle head 2.
Figure 13A:
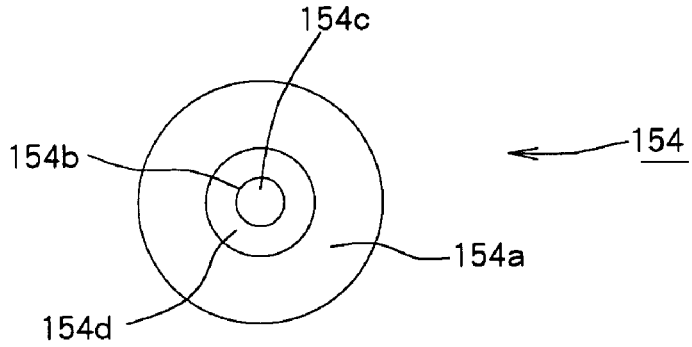
FIGS. 13(*a*)–13(*d*) are explanatory diagrams showing the first valve member 154.
Figure 13B:
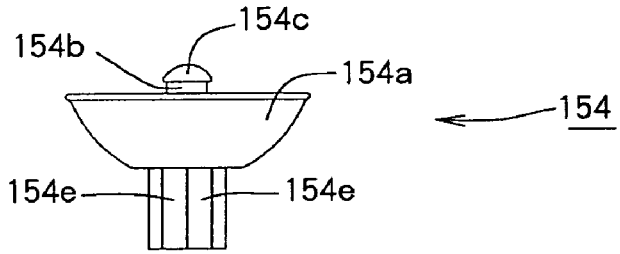
Figure 13C:
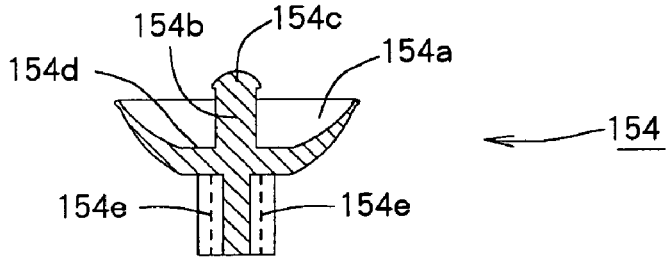
Figure 13D:
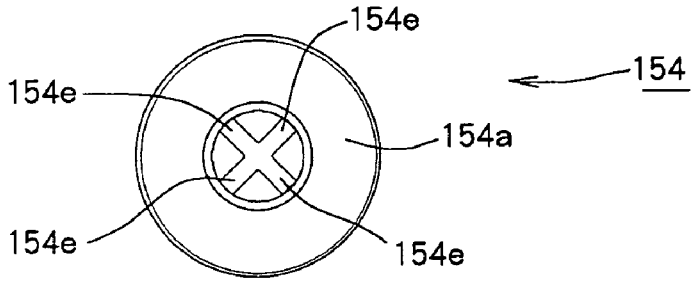

FIG. 11 and FIG. 12 are longitudinal sectional views showing a fluid-dispensing pump 5 according to a second embodiment of the present invention, together with the nozzle head 2, in a fluid container to which the fluid-dispensing pump 5 is applied. More specifically, FIG. 11 shows the stage when the fluid-dispensing pump 5 is allowed to stand without receiving any stress, and FIG. 12 shows the stage when the coupling tube 13 is moving downward together with the piston 12 by pressing the pressing portion 22 in the nozzle head 2.

This fluid-dispensing pump 5 according to the second embodiment uses a different outflow valve mechanism 15' from that of the first embodiment; i.e., the first valve member 154 is used instead of the first valve member 152 in the fluid-dispensing pump 1 according to the first embodiment.

FIG. 13 is an explanatory diagram showing the first valve member 154. More specifically, FIG. 13(*a*) is a plan view of the first valve member 154, FIG. 13(*b*) is a side view of the first valve member 154, FIG. 13(*c*) is a sectional side view of the first valve member 154, and FIG. 13(*d*) is a back view of the first valve member 154.

The first valve member 154 has the first valve body 154*a* configured to move between the closing position to close the opening portion in the first valve seat portion 151*a* and the opening position to open said opening portion, the supporting portion 154*b* set up from the first valve body 154*a*, and the rib 154*e* which is slidably inserted into the passage 151*d* in the valve seat member 151. Further, the first seizing portion 154*c* to restrict the upper limit of the movement of the second valve member 153 is formed at the upper end of the supporting portion 154 in this first valve member 154 and at the same time the second seizing portion 154*d* to restrict the lower limit of the movement of the second valve member 153 is formed at the lower end of the supporting portion 154*b*.

This first valve member 154 has the ribs 154*e*, thereby being able to stabilize the movement of the first valve body 154*a*. Further, four pieces of the rib 154*e* are preferably placed at even intervals to secure more stable movement of the first valve body 154*a*.

Figure 14:
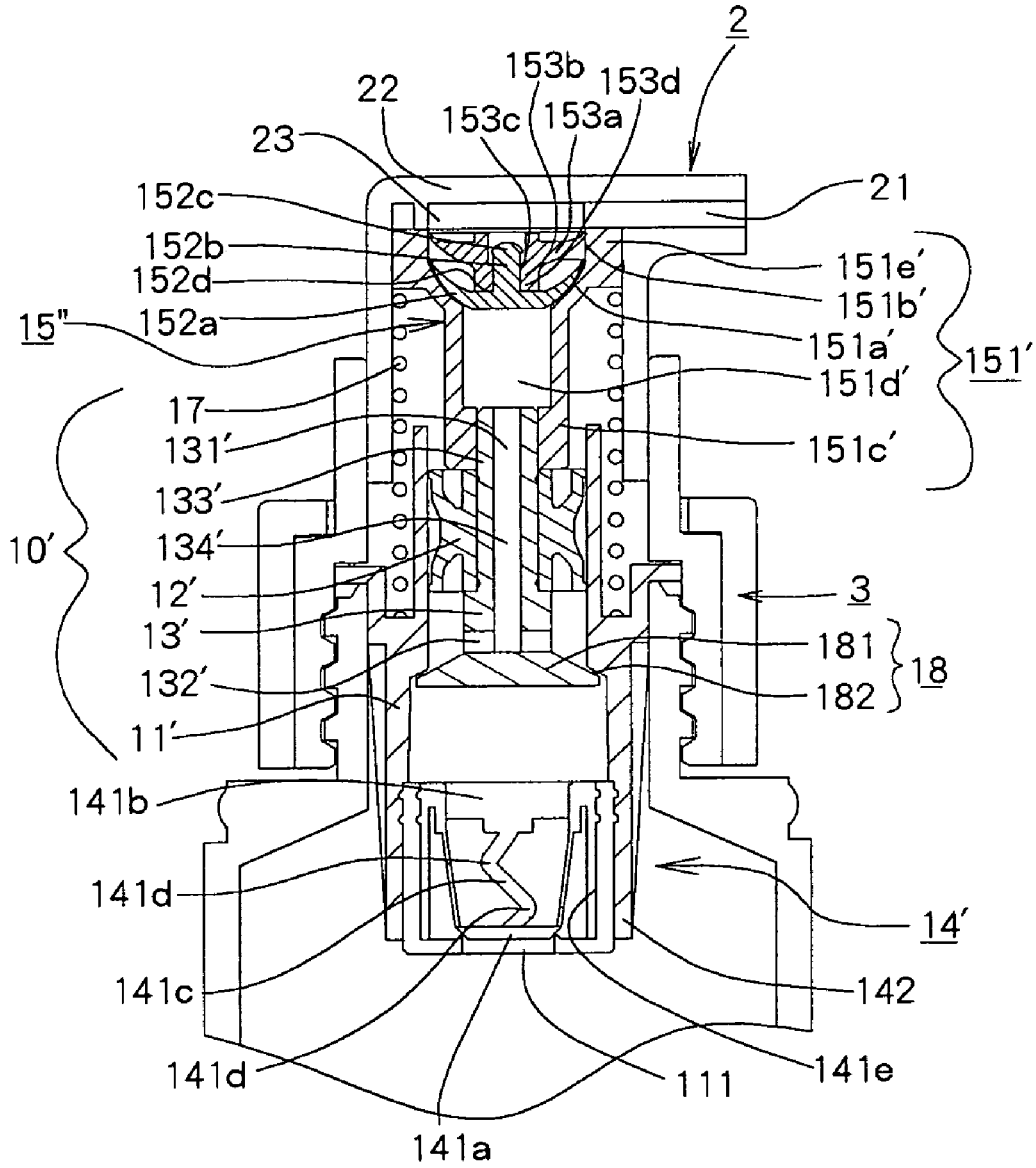
FIG. 14 is a longitudinal sectional view showing the fluid-dispensing pump 6 together with the nozzle head 2 according to a third embodiment of the present invention.

FIG. 14 is a longitudinal sectional view showing a fluid-dispensing pump 6 according to a third embodiment of the present invention, together with the nozzle head 2, in a fluid container to which the fluid-dispensing pump 6 is applied.

The fluid-dispensing pump 6 according to this third embodiment uses a different extendable/retractable member 10' from that of the first embodiment; i.e., a coupling tube 13' has a leak preventing mechanism 18 at the lower part of the coupling tube 13', which is cooperated with a cylinder 11'. An outflow valve mechanism 15" is also different from that of the first embodiment and uses a valve mechanism 151' in order to accommodate the coupling tube 13'. Elements 151*a*', 151*b*', 151*c*', 151*d*', and 151*e*' correspond to elements 151*a*, 151*b*, 151*c*, 151*d*, and 151*e* in the first embodiment, respectively.

The leak preventing mechanism 18 comprises a wall surface 182 formed inside the cylinder 11 and a nearly plate-like leak preventing valve 181 contacting the wall surface 182.

In this leak preventing mechanism 18, the leak preventing valve 181 is kept in contact with the wall surface 182 when no stress is applied to the pressing portion 22 in the nozzle head 2. In this way, it is possible to prevent the fluid flowed into the cylinder 11' from flowing into a fluid passage 131' of the coupling tube 13'. On the other hand, the leak preventing valve 181 moves downward to separate from the wall surface 182 when the pressing portion 22 in the nozzle head 2 is pressed.

An inflow port 133', a bonding portion 134', and an inflow port 132' correspond to the inflow port 133, the bonding portion 134, and the inflow port 132 of the first embodiment.

In this third embodiment, a piston 12' does not slide against the coupling tube 13' but slides only against an inner wall of the cylinder 11'.

Further, in an inflow valve mechanism 14' of this embodiment, the supporting portion 141*b* and the side support 141*e* are not press-fitted directly in the cylinder 11'. In this embodiment, the supporting portion 141*b* and the side support 141*e* are fitted in a separate valve seat member 142 which is then fitted in the cylinder 11'.

Figure 15:
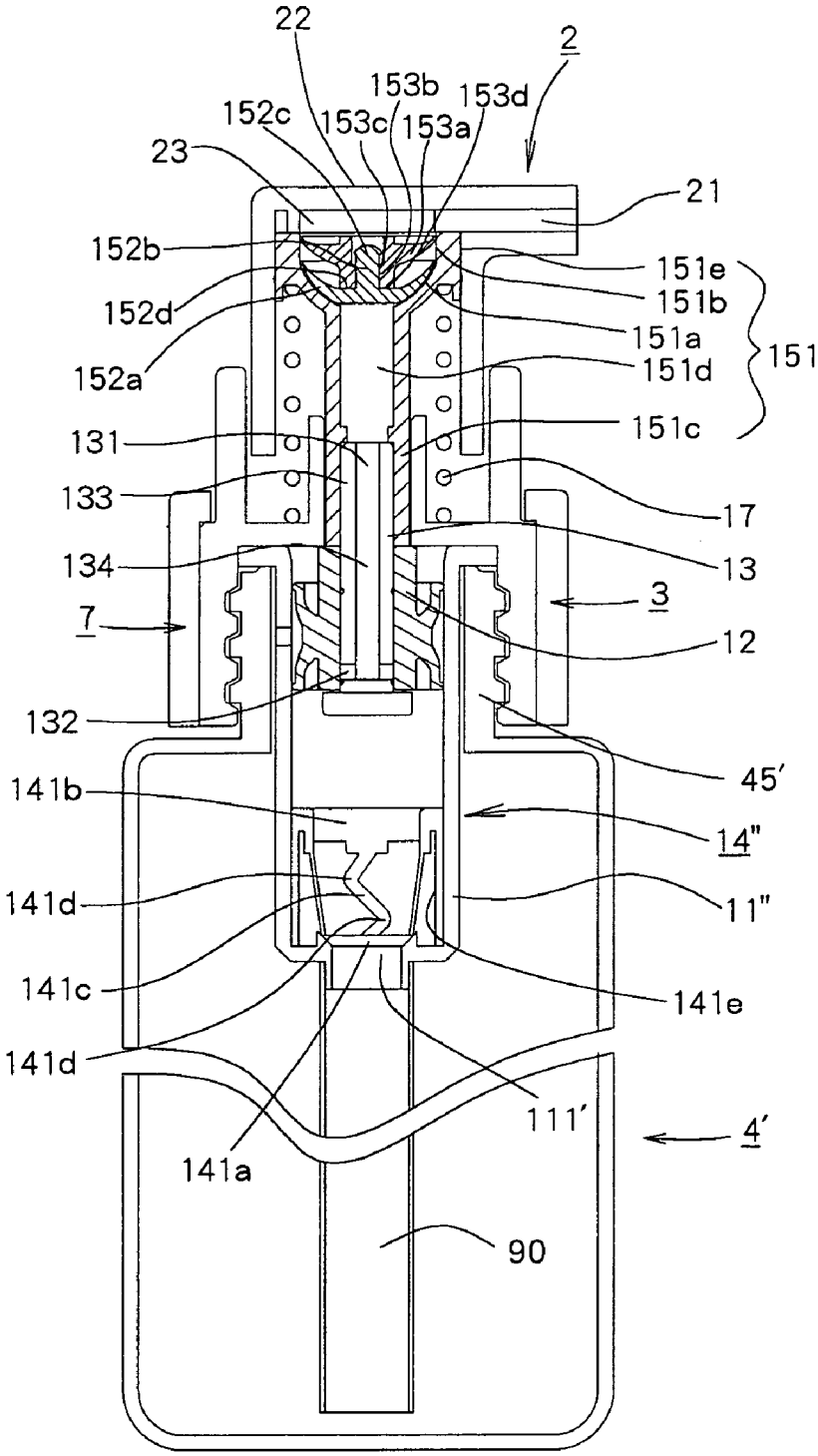
FIG. 15 is a longitudinal sectional view showing a fluid container to which the fluid-dispensing pump 7 according to a fourth embodiment of the invention is applied.

FIG. 15 is a longitudinal sectional view showing a fluid container to which a fluid-dispensing pump 7 according to the fourth embodiment of the present invention is applied.

The fluid-dispensing pump 7 according to this fourth embodiment has a suction tube 90 connected to an opening portion 111' of a cylinder 11" which is closed by the valve body 141*a* in an inflow valve mechanism 14". This suction tube 90 has a structure to be inserted into a fluid-storing portion 4'. Thus, unlike the fluid-storing portion 4 in the first embodiment, there is no need to have the piston member 42, which makes it possible to reduce the production cost. The pump 2 is attached to a mouth portion 45' of the container 11".

Figure 16:
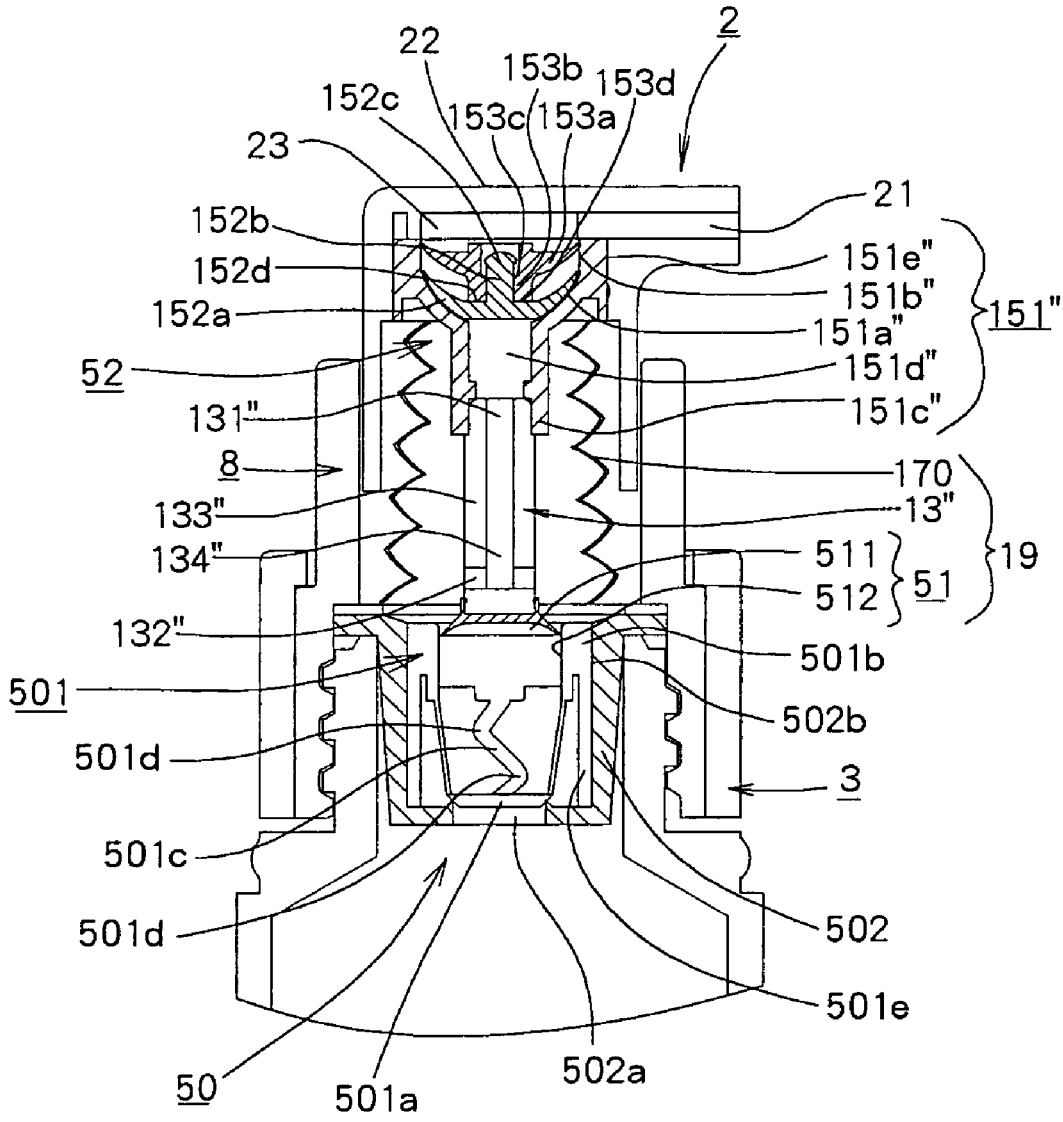
FIG. 16 is a longitudinal sectional view showing the fluid-dispensing pump 8 together with the nozzle head 2 according to a sixth embodiment of the present invention.

FIG. 16 is a longitudinal sectional view showing a fluid-dispensing pump 8 according to a fifth embodiment of the present invention, together with the nozzle head 2, in a fluid container to which the fluid-dispensing pump 8 is applied.

The fluid-dispensing pump 8 according to this fifth embodiment uses an extendable/retractable member 19 instead of the extendable/retractable member 10 in the fluid-dispensing pump 1 according to the first embodiment and an inflow valve mechanism 50 instead of the inflow valve mechanism 14 in the fluid-dispensing pump 1 according to the first embodiment. Further, the fluid-dispensing pump 8 has a leak preventing mechanism 51 disposed at the lower part of a coupling tube 13".

In this embodiment, the extendable/retractable member 19 does not include a piston connected to the coupling tube 13". Elements 131", 132", 133", and 134" correspond to elements 131, 132, 133, and 134 in the first embodiment, respectively. Due to the above differences, an outflow valve mechanism 52 has a slightly different valve member 151" from that of the first embodiment. Elements 151*a*", 151*b*", 151*c*", 151*d*", and 151*e*" correspond to elements 151*a*, 151*b*, 151*c*, 151*d*, and 151*e* in the first embodiment, respectively.

This extendable/retractable member 19 comprises a resinous bellows member 170. This extendable/retractable member 19 is formed by molding a resin having a specified elasticity into a bellows. The lower end of this extendable/retractable member 19 is liquid-tightly bonded to the inflow valve mechanism 50 and at the same time the upper end of the extendable/retractable member 19 is liquid-tightly bonded to the outflow valve mechanism 52.

The bellows member 170 serves as an urging member and a cylinder. However, a cylinder can be used inside the bellows member which in this case serves as an urging member only.

The inflow valve mechanism 50 comprises an inflow valve member 501 and an inflow valve seat member 502.

The inflow valve seat member 502 has an opening portion 502*a* formed to allow the fluid stored inside the fluid-storing portion 4 to flow into the extendable/retractable member 19. The inflow valve seat member 502 also has a fixing portion 502*b* and a side support 501*e* to fix the inflow valve member 501.

The inflow valve member 501 has a valve body 501*a* having a shape corresponding to the opening portion 502*a* formed in the inflow valve seat member 502, a supporting portion 501*b* fixed by bonding to the fixing portion 502*b* in the inflow valve seat member 502, four connecting portions 501*c* to connect the valve body 501*a* and the supporting portion 501*b*, and a wall surface 512 formed inside the supporting portion 501*b*. These four connecting portions 501*c* each have a pair of flexuous portions 501*d*. Consequently, this inflow valve member 501 has a more appropriate flexibility.

In this inflow valve mechanism 50, when the pressure inside the extendable/retractable member 19 becomes higher than the external pressure, the valve body 501*a* is located at the position to connect with the opening portion 502*a*, thereby closing the opening portion 502*a*. On the other hand, when the pressure inside the extendable/retractable member 19 becomes lower than the external pressure, the valve body 501*a* is located at the position separating from the opening portion 502*a*, thereby opening the opening portion 502*a*.

The leak preventing mechanism 51 comprises a leak preventing valve 511 bonded to the lower part of the coupling tube 13 and a wall surface 512 formed inside the supporting portion 501*b*. This leak preventing valve 511 comprises a nearly plate-like extendable/retractable member configured to contact the wall surface 512.

In this leak preventing mechanism 51, when no stress is applied to the pressing portion 22 in the nozzle head 2, the leak preventing valve 511 is in contact with the wall surface 512. In this way, the fluid flowed inside the inflow valve seat member 502 is prevented from flowing into the fluid passage 131" of the coupling tube 13". On the other hand, when the pressing portion 22 in the nozzle head 2 is pressed, the leak preventing valve 511 moves downward and separates from the wall surface 512.

Further, the inflow valve mechanism 14, 50 and the outflow valve mechanism 15 in the first to fifth embodiments according to the present invention described above are preferably constructed, for example, from a resin such as polyethylene and polypropylene, synthetic rubber such as silicone rubber, or a mixture of these materials.

Further, the structure of the inflow valve mechanism is not limited to the structure of the abovementioned inflow valve mechanism 14, 50, and can be any structure which is configured to close the opening portion when the pressure inside the extendable/retractable member 10, 19 becomes higher than the external pressure and is configured to open the opening portion when the pressure inside the extendable/retractable member 10, 19 becomes lower than the external pressure.

The above embodiments are not intended to limit the present invention. Any elements used in one embodiment may interchangeably be used in another embodiment, and any elements described herein can be used in any combination, as long as the use is feasible.

The present invention includes the above mentioned embodiments and other various embodiments. In at least one embodiment, at least one of the following effects may be accomplished.

1) In an embodiment, when the pressure inside the extendable/retractable member rises above the external pressure, the first valve body and the second valve body together move upward so that the first valve body moves to the opening position and at the same time the second valve body moves to the separating position, whereas when the pressure inside the extendable/retractable member falls below the external pressure, the first valve body and the second valve body together move downward, the second valve body moves to the contacting position, and then the first valve body moves to the closing position, so that the outflow valve mechanism can minimize the amount of the fluid remaining inside the nozzle head as much as possible. In this way, it is possible to prevent a change in the nature of the fluid, which is caused by exposing the fluid once flowed out into the nozzle head to the external air.

2) In an embodiment, the first valve member and the second valve member are connected in such a manner that they can alternately slide between the first engaging position to engage the first seizing portion and the first engaging portion and the second engaging position to engage the second seizing portion and the second engaging portion, so that the amount of the fluid remaining inside the nozzle head can be minimized as much as possible.

3) In an embodiment, a moving distance that the second valve body moves while contacting the inner wall in the second valve seat portion is smaller than a sliding distance between the first valve member, and the second valve member, so that it is possible to ensure that the first valve body moves to the closing position after the second valve body moves to the contacting position. In this way, the amount of the fluid remaining inside the nozzle head can be minimized as much as possible.

4) In an embodiment, the extendable/retractable member comprises the cylinder; the piston which can reciprocate inside the cylinder, the coupling tube in which the hollow fluid passage is formed, and the flexible member disposed on the periphery of the coupling tube, so that it becomes possible to effectively prevent corrosion of coil springs or dissolution of metal components.

5) In an embodiment, the extendable/retractable member comprises a resinous bellows member, so that it becomes possible to effectively prevent corrosion of coil springs or dissolution of metal components despite its simple configuration.

The present application claims priority to Japanese Patent Application No. 2004-208299, filed Jul. 15, 2004, the disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A fluid-dispensing pump for dispensing a fluid stored inside a fluid-storing portion from a nozzle head set up above the fluid-storing portion, by pressing the nozzle head, comprising:

an extendable/retractable member disposed between the fluid-storing portion and the nozzle head, for storing the fluid therein;

an inflow valve mechanism disposed at a lower end of the extendable/retractable member, for introducing the fluid stored in the fluid-storing portion into the extendable/retractable member; and an outflow valve mechanism disposed at an upper end of the extendable/retractable member, for discharging therefrom the fluid contained in the extendable/retractable member to the nozzle head, said outflow valve mechanism comprising (i) a valve seat member having an opening portion constituting a fluid path through which the fluid passes, (ii) a first valve member for closing the fluid path by contacting a first portion of the valve seat member in accordance with the pressure inside the extendable/retractable member, and (iii) a second valve member for closing the fluid path by contacting a second portion of the valve seat member in accordance with the pressure inside the extendable/retractable member, wherein the first valve member and the second valve member are coupled with each other and unbiased, and the second portion is arranged downstream of the first portion.

2. The fluid-dispensing pump according to claim 1, wherein the first valve member and the second valve member are connected to no other structures.

3. The fluid-dispensing pump according to claim 1, wherein the first valve member and the second valve member are movably coupled with each other.

4. The fluid-dispensing pump according to claim 1, wherein the first valve member is more resilient than the second valve member.

5. The fluid-dispensing pump according to claim 1, wherein the valve seat member has a cone-shaped bottom having the opening portion.

6. The fluid-dispensing pump according to claim 5, wherein the cone-shaped bottom has an annular-projection around the opening portion, wherein the first valve member is in contact with the annular projection to close the fluid path at the opening portion.

7. The fluid-dispensing pump according to claim 6, wherein the periphery of the second valve member is in contact with an inner wall of the valve seat member to close the fluid path.

8. The fluid-dispensing pump according to claim 3, wherein the first valve member and the second valve member are configured to (i) together move upward to an opening position and a separating position, respectively, when the pressure inside the extendable/retractable member exceeds the external pressure, and (ii) move downward from the opening position and the separating position to a closing position and a contacting position, respectively, when the pressure inside the extendable/retractable member falls below the external pressure, wherein the first valve member starts moving downward earlier than the second valve member.

9. The fluid-dispensing pump according to claim 8, wherein the first valve member is configured to move more easily than the second valve member.

10. The fluid-dispensing pump according to claim 9, wherein the contacting position has a width through which the second valve member is configured to move while the second valve member is in contact with the second portion of the valve seat member until the first valve member moves to the closing position.

11. The fluid-dispensing pump according to claim 10, wherein the width of the contacting position is longer than a distance which the first valve member moves relative to the second valve member.

12. The fluid-dispensing pump according to claim 8, further comprising a pressing portion having a discharge port, wherein an upper portion of the valve seat member is connected to the pressing portion and is communicated with the discharge port, wherein when the first valve member and the second valve member are placed at the closing position and the connecting position, respectively, a periphery of the second valve member is below a lower surface of the discharge port, and when the first valve member and the second valve member are placed at the opening position and the separating position, respectively, the periphery of the second valve member and a periphery of the first valve member are above the lower surface of the discharge port.

13. The fluid-dispensing pump according to claim 12, wherein a distance between the periphery of the first valve member and the periphery of the second valve member is substantially or nearly the same as an inner diameter of the discharge port, when the first valve member and the second valve member are placed at the closing position and the connecting position, respectively.

14. The fluid-dispensing pump according to claim 1, wherein the first valve member comprises (a) a first valve body configured to move between a closing position for closing the fluid path and an opening position for opening the fluid path, and (b) a supporting portion extending upward from the first valve body, configured to slidably support the second valve member, said second valve member comprising (c) a second valve body configured to move between a contacting position for contacting an inner wall of the second portion of the valve seat member and a separating position for separating from the inner wall, and (d) a connecting portion to be connected to the supporting portion of the first valve member.

15. The fluid-dispensing pump according to claim 14, wherein the supporting portion has a seizing portion at its top end for restricting the movement of the second valve member.

16. The fluid-dispensing pump according to claim 15, wherein the first valve member and the second valve member are configured to (i) together move upward to the opening position and the separating position, respectively, when the pressure inside the extendable/retractable member exceeds the external pressure, and (ii) move downward from the opening position and the separating position to the closing position and the contacting position, respectively, when the pressure inside the extendable/retractable member falls below the external pressure, wherein the first valve member starts moving downward earlier than the second valve member.

17. The fluid-dispensing pump according to claim 8, wherein the first valve member is configured to move more easily than the second valve member.

18. The fluid-dispensing pump according to claim 17, wherein the contacting position has a width through which the second valve member is configured to move while the second valve member is in contact with the inner wall of the second portion of the valve seat member until the first valve member moves to the closing position.

19. The fluid-dispensing pump according to claim 18, wherein the width of the contacting position is longer than a distance in which the first valve member moves relative to the second valve member.

20. The fluid-dispensing pump according to claim 1, wherein the extendable/retractable member comprises:

a cylinder;

a piston which can reciprocate inside the cylinder;

a coupling tube in which a hollow fluid passage is formed by connecting the nozzle head and the piston so that pressing force applied to the nozzle head is transmitted to the piston to move downward; and a urging member disposed around the coupling tube for urging the piston in an upward direction via the coupling tube.

21. The fluid-dispensing pump according to claim 1, wherein the extendable/retractable member comprises a resinous bellows member.

22. A fluid-dispensing pump for discharging a fluid stored inside a fluid-storing portion from a nozzle head set up above the fluid-storing portion, by pressing the nozzle head, comprising:

an extendable/retractable member which is disposed at an upper part of the fluid-storing portion and can change its shape between an extended position to store a relatively large amount of the fluid therein and a retracted position to store a relatively small amount of the fluid therein;

an inflow valve mechanism which is connected to a lower end of the extendable/retractable member and allows the fluid stored in the fluid-storing portion to flow into the extendable/retractable member; and an outflow valve mechanism which is connected to the upper end of the extendable/retractable member and allows the fluid flowed into the extendable/retractable member to flow out into the nozzle head;

said outflow valve mechanism being comprised of a first valve seat portion at the bottom of which an opening portion is formed;

a first valve member which has a first valve body configure to move between a closing position for closing the opening portion and an opening position for opening the opening portion in the first valve seat portion and a supporting portion set up from the first valve body;

a second valve seat portion which is disposed at the upper part of the first valve seat portion and has a nearly cylindrical inner wall; and a second valve member which has a second valve body configured to move between a contacting position for contacting the inner wall in the second valve seat portion and a separating position for separating from the inner wall and a connecting portion to be connected to the supporting portion of the first valve member;

wherein when the pressure inside the extendable/retractable member rises above the external pressure, the first valve body and the second valve body together move upward so that the first valve body moves to the opening position and at the same time the second valve body moves to the separating position; and wherein when the pressure inside the extendable/retractable member falls below the external pressure, the first valve body and the second valve body together move downward, the second valve body moves to the contacting position, and then the first valve body moves to the closing position.

23. The fluid-dispensing pump according to claim 22, wherein a first seizing portion is formed at the top end of the supporting portion in the first valve member and at the same time a second seizing portion is formed at its lower end, a first engaging portion is formed to engage with the first seizing portion and at the same time a second engaging portion is formed to engage with the second seizing portion, and the first valve member and the second valve member are connected so that they can alternately slide between a first engaging position to engage the first seizing portion and the first engaging portion and a second engaging position to engage the second seizing portion and the second engaging portion.

24. The fluid-dispensing pump according to claim 23, wherein a moving distance that the second valve body moves while contacting the inner wall in the second valve seat portion is smaller than a sliding distance between the first valve member and the second valve member.

25. The fluid-dispensing pump according to claim 22, wherein the extendable/retractable member comprises:

a cylinder;

a piston which can reciprocate inside the cylinder;

a coupling tube in which a hollow fluid passage is formed by connecting the nozzle head and the piston so that a pressing force applied to the nozzle head is transmitted to the piston to move it downward; and a flexible member disposed on the periphery of the coupling tube for giving momentum to the piston in an ascending direction via the coupling tube.

26. The fluid-dispensing pump according to claim 22, wherein the extendable/retractable member comprises a resinous bellows member.

27. A container comprising the fluid-dispensing pump of claim 1, the fluid-storing portion, the nozzle head, and a lid portion which connects the dispensing pump to a mouth portion of the fluid-storing portion.

28. A container comprising the fluid-dispensing pump of claim 22, the fluid-storing portion, the nozzle head, and a lid portion which connects the dispensing pump to a mouth portion of the fluid-storing portion.

* * * * *